US011078645B2

(12) United States Patent
Yumoto et al.

(10) Patent No.: US 11,078,645 B2
(45) Date of Patent: Aug. 3, 2021

(54) SLEWING-TYPE WORKING MACHINE

(71) Applicant: KOBELCO CONSTRUCTION MACHINERY CO., LTD., Hiroshima (JP)

(72) Inventors: Natsuki Yumoto, Hiroshima (JP); Koji Ueda, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 210 days.

(21) Appl. No.: 16/358,170

(22) Filed: Mar. 19, 2019

(65) Prior Publication Data

US 2019/0301135 A1 Oct. 3, 2019

(30) Foreign Application Priority Data

Mar. 29, 2018 (JP) ..... JP2018-064923

(51) Int. Cl.
*E02F 9/12* (2006.01)
*F15B 11/16* (2006.01)
*E02F 9/22* (2006.01)

(52) U.S. Cl.
CPC ..... *E02F 9/123* (2013.01); *E02F 9/2225* (2013.01); *E02F 9/2235* (2013.01);
(Continued)

(58) Field of Classification Search
CPC ..... E02F 9/22; E02F 9/2225; E02F 9/2203; E02F 3/4135; E02F 9/2025; E02F 3/3654;
(Continued)

(56) References Cited

U.S. PATENT DOCUMENTS 3,613,798 A * 10/1971 Mohan ..... A01B 63/1117 172/9
6,119,054 A * 9/2000 Miki ..... E02F 9/2025 700/275

(Continued)

FOREIGN PATENT DOCUMENTS

EP 1 674 735 A2 6/2006
EP 1 980 674 A1 10/2008

(Continued)

OTHER PUBLICATIONS

Extended European Search Report dated Jul. 18, 2019 in Patent Application No. 19160488.3, 7 pages.

(Continued)

*Primary Examiner* — Yuri Kan
(74) *Attorney, Agent, or Firm* — Oblon, McClelland, Maier & Neustadt, L.L.P.

(57) ABSTRACT

An opening and closing motion control section controls an optional control valve so as to reduce opening degree of the optional control valve in a case where a first opening reduction condition is satisfied that a slewing operation detection section detects an operation amount equal to or more than a reference operation amount set in advance so that the reference operation amount is larger than a minimum operation amount of a slewing operation member for causing slewing motion of an upper slewing body and that an optional operation detection section detects operation received by an optional operation member.

4 Claims, 15 Drawing Sheets

(52) U.S. Cl.
CPC ..... *E02F 9/2246* (2013.01); *E02F 9/2267* (2013.01); *E02F 9/2296* (2013.01)

(58) Field of Classification Search
CPC ..... E02F 9/2228; E02F 9/12; G05B 19/042; A01B 63/1117; A01B 63/10; F15B 11/16; F15B 19/005; F15B 11/08; F15B 11/162
See application file for complete search history.

(56) References Cited

U.S. PATENT DOCUMENTS

| | | | | |
|---|---|---|---|---|
| 6,354,081 | B1 * | 3/2002 | Burton | A01B 63/10 15/82 |
| 6,557,277 | B1 * | 5/2003 | Hibi | E02F 3/4135 37/187 |
| 2003/0172650 | A1 * | 9/2003 | Konishi | F15B 11/162 60/421 |
| 2004/0024510 | A1 * | 2/2004 | Finley | G05B 19/042 701/50 |
| 2006/0288863 | A1 * | 12/2006 | Ueda | F15B 19/005 91/459 |
| 2008/0250782 | A1 | 10/2008 | Takeshita | |
| 2010/0275589 | A1 * | 11/2010 | Meyers | E02F 9/2203 60/327 |
| 2015/0285241 | A1 * | 10/2015 | Bang | E02F 9/2228 700/282 |
| 2017/0002545 | A1 * | 1/2017 | Kaneta | F15B 11/08 |
| 2018/0058043 | A1 * | 3/2018 | Beckhusen | E02F 3/3654 |

FOREIGN PATENT DOCUMENTS

| | | | | |
|---|---|---|---|---|
| GB | 2 315 521 A | | 2/1998 | |
| GB | 2315521 A | * | 2/1998 | F15B 11/16 |
| JP | 2001295804 A | * | 10/2001 | E02F 9/2225 |
| JP | 2008-261373 | | 10/2008 | |

OTHER PUBLICATIONS

Office Action dated Jan. 14, 2020 in Japanese Patent Application No. 2018-064923, 6 pages (with English Translation).

* cited by examiner

FIG. 6

| OPTIONAL DEVICE | WORKING PRESSURE | OPTIONAL CONTROL VALVE |
|---|---|---|
| GRAPPLE | LOW | THROTTLE |
| CRUSHER | HIGH | NOT THROTTLE |
| BREAKER | HIGH | NOT THROTTLE |
| FORK | LOW | THROTTLE |

(A)

(B)

(C)

SLEWING-TYPE WORKING MACHINE

TECHNICAL FIELD

The present invention relates to a slewing-type working machine equipped with an upper slewing body to which an attachment including an optional device is attached.

BACKGROUND ART

A common slewing-type working machine includes a lower travelling body, an upper slewing body mounted on the lower travelling body so as to be slewable, an attachment attached to the upper slewing body, a slewing motor which is a hydraulic motor that slews the upper slewing body, a hydraulic pump which discharges hydraulic fluid to be supplied to the slewing motor, and a slewing control valve interposed between the hydraulic pump and the slewing motor. The slewing control valve opens/closes according to operation of a slewing operation lever by an operator to change a flow rate of hydraulic fluid supplied to the slewing motor out of hydraulic fluid discharged from the hydraulic pump.

The attachment includes a boom attached to the upper slewing body so as to be capable of going up and down, an arm attached to a front end portion of the boom, and a working device such as a bucket attached to a front end portion of the arm. The slewing-type working machine further includes an actuator which operates the attachment. Then, the hydraulic fluid discharged by the hydraulic pump is used in many cases not only for the slewing motor but also for the actuator. In this case, the actuator is connected to the hydraulic pump via a dedicated control valve different from the slewing control valve. Specifically, the hydraulic pump is used for supply of hydraulic fluid to the slewing motor and supply of hydraulic fluid to the actuator. In a slewing-type working machine of this type, it is important how to distribute a flow rate of hydraulic fluid to be supplied from the hydraulic pump to the slewing motor and the actuator when slewing operation of actuating the slewing motor and operation of actuating the actuator are simultaneously conducted, i.e. in combined operation.

For example, Unexamined Japanese Patent Publication No. 2008-261373 discloses a hydraulic controller of a working machine configured to actuate a slewing priority valve by a slewing pilot pressure to give priority to slewing motion while throttling a meter-in flow rate of an arm cylinder at the time of combined operation of simultaneously conducting slewing operation and arm pulling operation.

In a slewing-type working machine having an attachment as described above, as the working device attached to the front end portion of the arm, an optional device such as a grapple, a fork, or the like may be used in place of a bucket disclosed in FIG. 3 of Unexamined Japanese Patent Publication No. 2008-261373. These optional devices operate in a unique manner different from that of a bucket. For example, in a grapple, a plurality of claws conduct opening and closing motion and in the fork, a pair of opening and closing arms conducts opening and closing motion. Accordingly, the slewing-type working machine is provided with an optional actuator which realizes unique motion of such an optional device as described above.

In the slewing-type working machine, a hydraulic pump is used for both of supply of hydraulic fluid to a slewing motor and supply of hydraulic fluid to the optional actuator in some cases, and an operator may conduct combined operation in which optional operation of grasping an object to be carried by a grapple or a fork and slewing operation of slewing an upper slewing body are performed simultaneously. In such a case, when a working pressure of the optional actuator is low, a working pressure of the slewing motor accordingly becomes low, so that it is difficult to start slewing of the upper slewing body. Possible means for reliably starting slewing of the upper slewing body is increasing a supply flow rate of hydraulic fluid to the slewing motor to give priority to slewing motion.

However, in the combined operation in which slewing operation and optional operation are conducted simultaneously, an operator may slowly slew the upper slewing body to accurately move an object to be carried, which is to be grasped by the optional device, to a predetermined place. In such a case, the operator does not operate a slewing operation lever to a full stroke but conducts half lever operation of stopping the operation before the full stroke. Then, at the time of combined operation in which slewing operation by such half lever operation and optional operation are conducted simultaneously, when a supply flow rate of hydraulic fluid to the slewing motor is increased to give priority to the slewing motion, the upper slewing body might have an increased speed against operator's intention.

SUMMARY OF INVENTION

An object of the present invention is to provide a slewing-type working machine capable of giving priority to slewing motion when a speed of an upper slewing body should be increased and also capable of suppressing an increase in a speed of the upper slewing body against operator's intention in combined operation in which slewing operation and optional operation are conducted simultaneously.

A slewing-type working machine of the present invention includes a base body; an upper slewing body mounted on the base body so as to be slewable; an attachment including an attachment main body attached to the upper slewing body and at least one optional device detachably attached to a front end portion of the attachment main body; a variable displacement hydraulic pump which discharges hydraulic fluid; a slewing motor which receives supply of the hydraulic fluid discharged from the hydraulic pump to operate so as to slew the upper slewing body; an optional actuator which receives supply of the hydraulic fluid discharged from the hydraulic pump to operate so as to operate the optional device; a slewing operation member configured to receive slewing operation for slewing the upper slewing body; a slewing operation detection section which detects the slewing operation received by the slewing operation member; an optional operation member configured to receive operation for causing the optional device to operate; an optional operation detection section which detects the operation received by the optional operation member; an optional control valve interposed between the hydraulic pump and the optional actuator and configured to open and close so as to change a flow rate of the hydraulic fluid supplied from the hydraulic pump to the optional actuator; and an opening and closing motion control section which controls opening and closing motion of the optional control valve. The opening and closing motion control section controls the optional control valve so as to reduce opening degree of the optional control valve only when an opening reduction condition set in advance for judging whether or not the opening degree of the optional control valve is to be reduced is satisfied. The opening reduction condition includes a first opening reduction condition that the slewing operation detection section detects an operation amount equal to or more than a reference operation amount set in advance so that the reference operation amount is larger than a minimum operation amount of the slewing operation member for causing slewing motion of the upper slewing body and that the optional operation detection section detects the operation received by the optional operation member. The opening and closing motion control section controls the optional control valve so as to reduce the opening degree of the optional control valve in a case where the first opening reduction condition is satisfied.

BRIEF DESCRIPTION OF DRAWINGS

FIG. 6 is a table showing a relation between an optional device and a working pressure and a relation between the optional device and control of an optional control valve in the slewing-type working machine according to the present embodiment;

DESCRIPTION OF EMBODIMENTS

Figure 1:
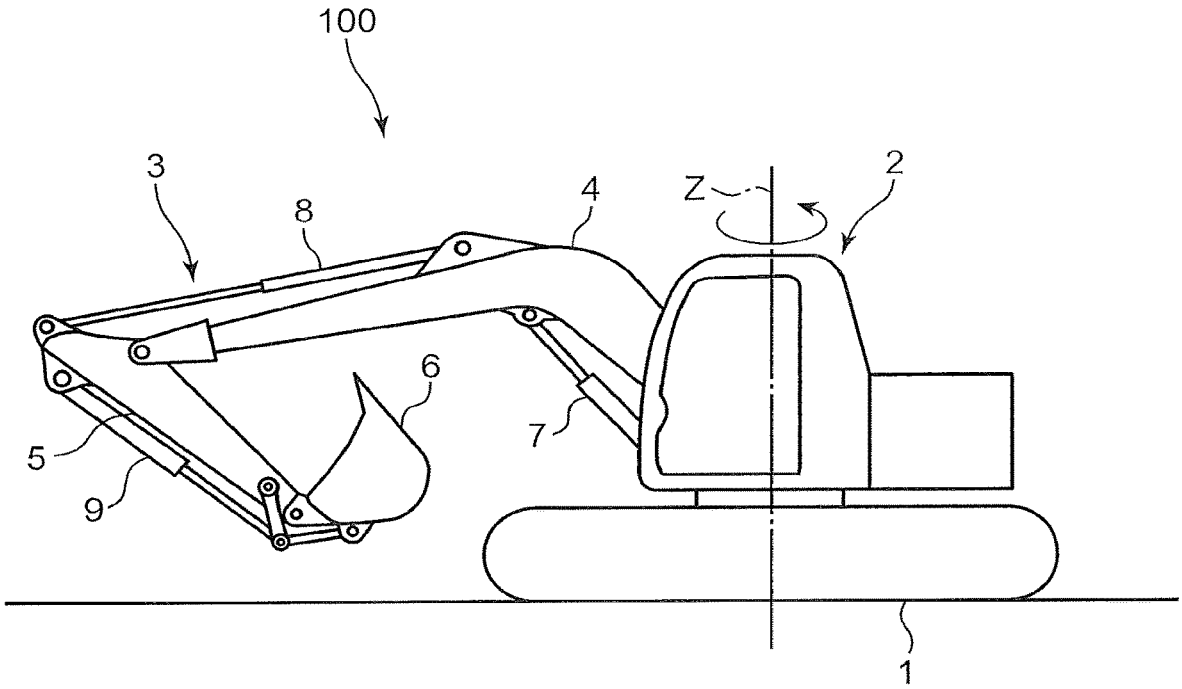
FIG. 1 is a side view showing a slewing-type working machine according to an embodiment of the present invention.

In the following, an embodiment of the present invention will be described with reference to the drawings. FIG. 1 is a side view showing a slewing-type working machine 100 according to an embodiment of the present invention. The slewing-type working machine 100 includes a crawler type lower travelling body 1 constituting a base body, an upper slewing body 2 mounted on the lower travelling body 1 so as to be slewable around a slewing central axis Z vertical to a travelling surface of the lower travelling body, an attachment 3 mounted on the upper slewing body 2, a variable displacement hydraulic pump 20 (see FIG. 7) which discharges hydraulic fluid, a slewing motor 30 (see FIG. 7) which receives supply of the hydraulic fluid discharged from the hydraulic pump 20 to operate to slew the upper slewing body 2, and an actuator (hydraulic actuator) for causing the attachment 3 to operate.

In the present embodiment, the attachment 3 includes an attachment main body, and a working device to be detachably attached to a front end portion of the attachment main body. In the present embodiment, the attachment main body includes a boom 4 attached to the upper slewing body 2 so as to be capable of going up and down, and an a m 5 attached to a front end portion of the boom 4, and the working device is detachably attached to a front end portion of the arm 5. As the working device, optional devices 6A to 6D shown in FIG. 2 to FIG. 5 can be used other than a bucket 6 attached to the front end portion of the arm 5 in FIG. 1. In other words, on the front end portion of the arm 5 in the slewing-type working machine 100 shown in FIG. 1, any of the optional devices 6A to 6D can be attached in place of the bucket 6.

The actuator includes a boom cylinder 7 for operating the boom 4, an arm cylinder 8 for operating the arm 5, a swing cylinder 9 which causes the working device to move with respect to the arm 5, and an optional cylinder 10 (see FIG. 7), which is a cylinder separate from the swing cylinder 9, as an optional actuator which causes each of the optional devices 6A to 6D to conduct unique motion.

Figure 2:
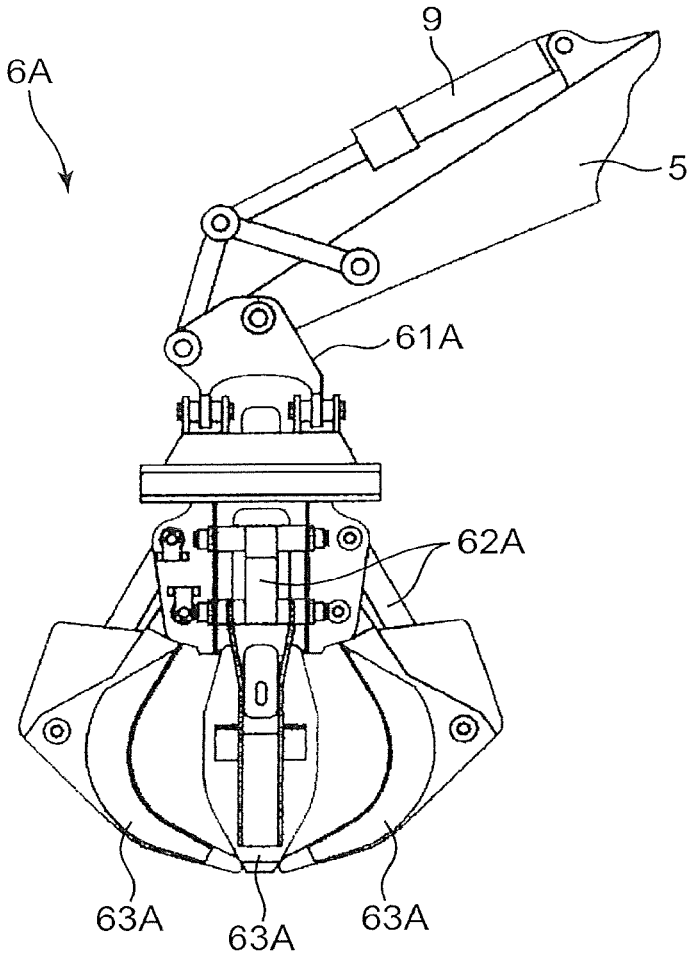
FIG. 2 is a schematic view showing a grapple as one example of an optional device attached to a front end portion of an arm of the slewing-type working machine.

The optional device 6A shown in FIG. 2 is a grapple 6A which grasps and conveys scraps in, for example, scrap yard or the like. The grapple 6A includes a bracket 61A attached to the front end portion of the arm 5, a grapple main body 62A supported by the bracket 61A, and a plurality of claws 63A (four claws 63A in FIG. 2) supported by the grapple main body 62A. The optional cylinder 10 is provided in the grapple main body 62A.

Figure 3:
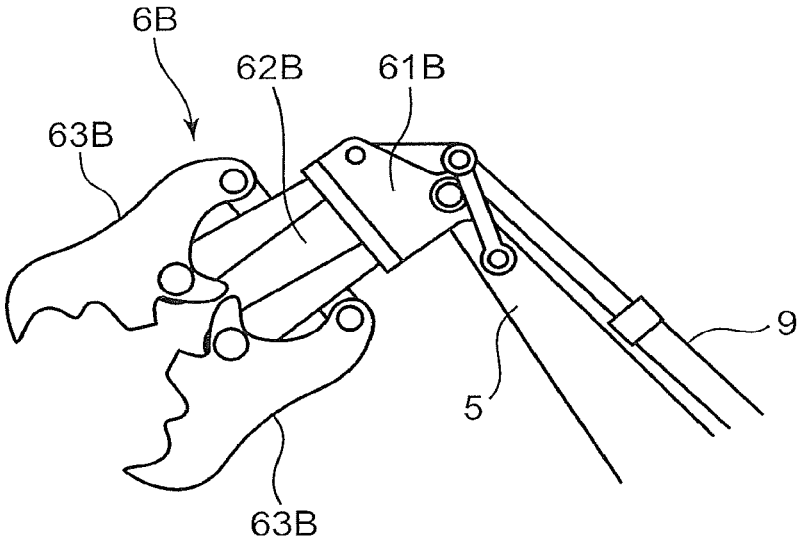
FIG. 3 is a schematic view showing a crusher as one example of an optional device attached to the front end portion of the arm of the slewing-type working machine.

The optional device 6B shown in FIG. 3 is a crusher 6B (grinder) for taking apart, for example, concrete structure or the like. The crusher 6B includes a bracket 61B attached to the front end portion of the arm 5, a crusher main body 62B supported by the bracket 61B, and a pair of crusher arms 63B supported by the crusher main body 62B. The optional cylinder 10 is provided in the crusher main body 62B.

Figure 4:
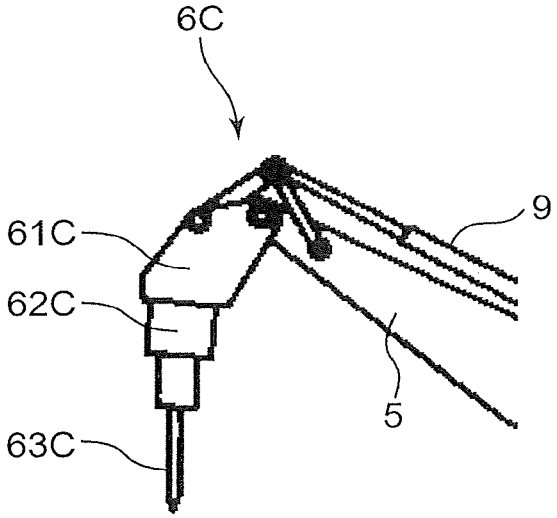
FIG. 4 is a schematic view showing a breaker as one example of an optional device attached to the front end portion of the arm of the slewing-type working machine.

The optional device 6C shown in FIG. 4 is a breaker 6C for use in, for example, digging bedrock, splitting rock, crushing concrete, and the like. The breaker 6C includes a bracket 61C attached to the front end portion of the arm 5, a breaker main body 62C supported by the bracket 61C, and a chisel 63C supported by the breaker main body 62C and capable of moving back and forth in an axial direction thereof. The optional cylinder 10 is provided in the breaker main body 62C.

Figure 5:
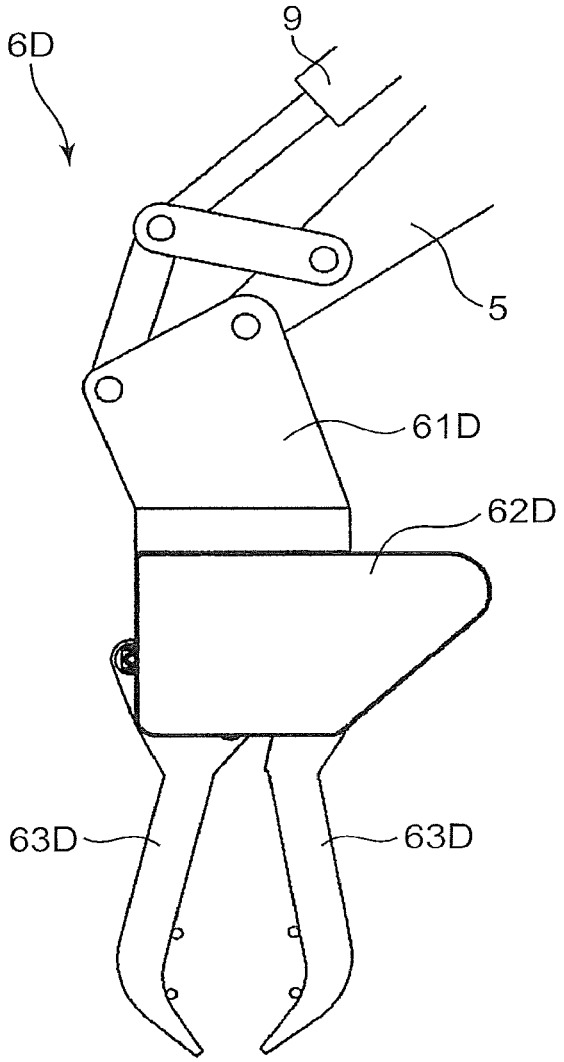
FIG. 5 is a schematic view showing a fork as one example of an optional device attached to the front end portion of the arm of the slewing-type working machine.

The optional device 6D shown in FIG. 5 is a fork 6D for grasping, for example, an object to be carried. The fork 6D includes a bracket 61D attached to the front end portion of the arm 5, a fork main body 62D supported by the bracket 61D, and a pair of opening and closing arms 63D supported by the fork main body 62D. The optional cylinder 10 is provided in the fork main body 62D.

The optional cylinder 10 is provided for causing each optional device to conduct unique motion in any of the optional devices 6A to 6D. In other words, the optional cylinder 10 provided in the grapple 6A causes the plurality of claws 63A to open and close. The optional cylinder 10 provided in the crusher 6B causes the pair of crusher arms 63B to open and close. The optional cylinder 10 provided in the breaker 6C causes the chisel 63C to advance or retreat (move back and forth) in the axial direction thereof with respect to the breaker main body 62C. The optional cylinder 10 provided in the fork 6D causes the pair of opening and closing arms 63D to open and close. Such optional cylinders 10 are not provided in the bucket 6.

Working pressure required for the unique motion conducted by the optional devices 6A to 6D varies depending on a kind of optional device. Of the optional devices 6A to 6D, the grapple 6A and the fork 6D generally have low working pressures and the crusher 6B and the breaker 6C generally have high working pressures. Accordingly, the optional devices 6A to 6D are classified into a first optional device having a relatively low working pressure and a second optional device having a relatively high working pressure. Specifically, as shown in FIG. 6, the first optional device includes the grapple 6A and the fork 6D and the second optional device includes the crusher 6B and the breaker 6C.

The optional cylinder 10 is configured to receive supply of hydraulic fluid to operate, the hydraulic fluid being discharged from the same hydraulic pump 20 as the hydraulic pump 20 which drives the slewing motor 30. The boom cylinder 7, the arm cylinder 8, and the swing cylinder 9 may be configured to receive supply of hydraulic fluid to operate, the hydraulic fluid being discharged from the same hydraulic pump 20 as that for the slewing motor 30, or may be configured not to receive supply of hydraulic fluid to operate, the hydraulic fluid being discharged from the same hydraulic pump 20 as that for the slewing motor 30, but to receive supply of hydraulic fluid to operate, the hydraulic fluid being discharged from the hydraulic pump 20 different from that for the slewing motor 30.

Figure 7:
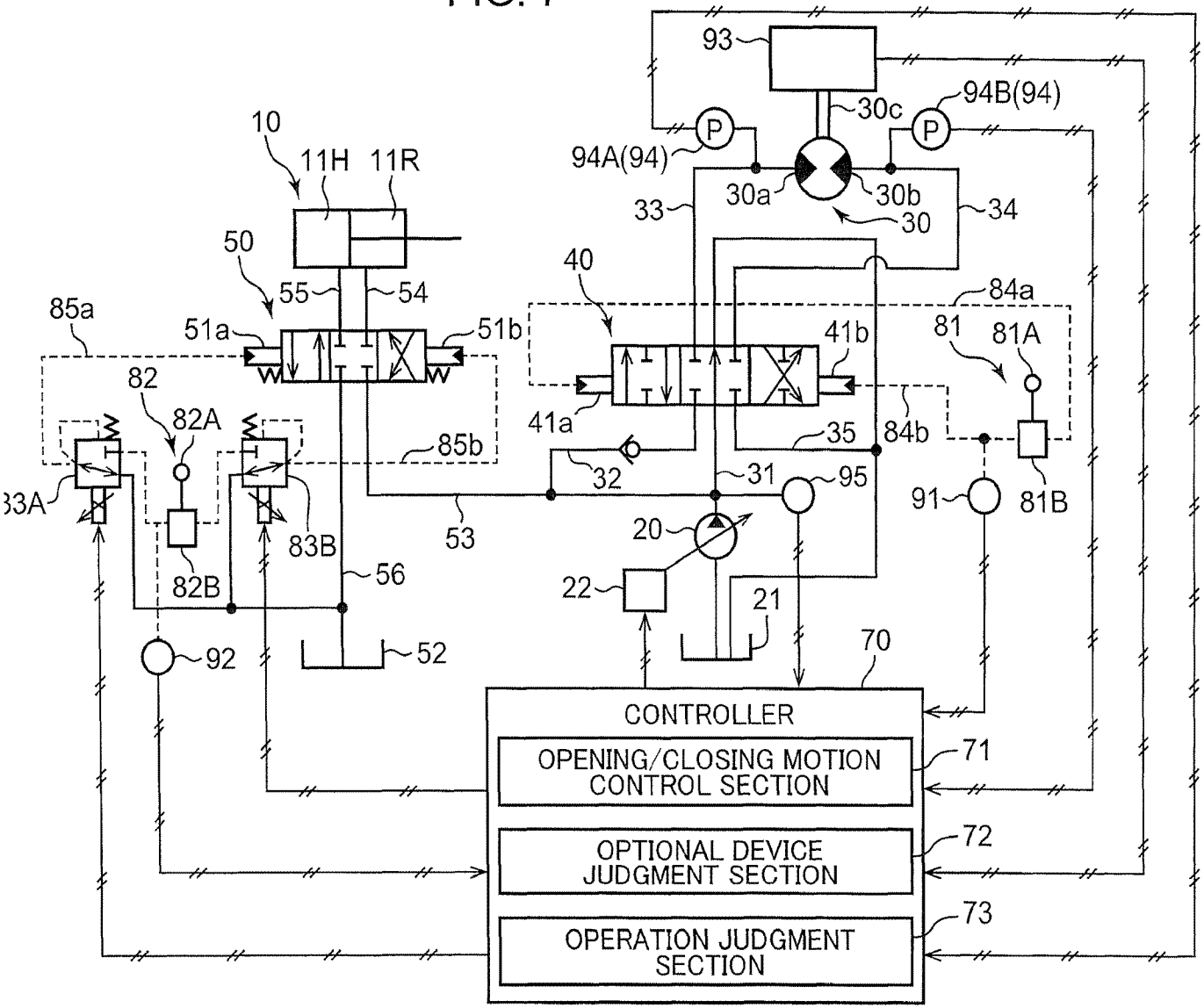
FIG. 7 is a diagram showing a hydraulic circuit mounted on the slewing-type working machine according to the present embodiment.

FIG. 7 is a diagram showing a hydraulic circuit mounted on the slewing-type working machine 100 according to the present embodiment. In the hydraulic circuit, a part related to the slewing motion of the upper slewing body 2 and the unique motion in the optional devices 6A to 6D is shown. The hydraulic circuit includes the slewing motor 30, the optional cylinder 10, the hydraulic pump 20, a slewing control valve 40, and an optional control valve 50.

The slewing motor 30 is a hydraulic motor for slewing the upper slewing body 2. The slewing motor 30 has an output shaft 30*c* that rotates when the slewing motor 30 receives supply of hydraulic fluid, the output shaft 30*e* being coupled to the upper slewing body 2 so as to slew the upper slewing body 2 in both right and left directions. Specifically, the slewing motor 30 has a first port 30*a* and a second port 30*b*, in which one of the ports receives supply of hydraulic fluid to cause the output shaft 30*c* to rotate in a direction corresponding to the one of the ports and also the other port discharges hydraulic fluid.

The optional cylinders 10 are provided in the optional devices 6A to 6D to receive supply of hydraulic fluid and operate in an extension/contraction direction such that the unique motion is conducted in the optional devices 6A to 6D.

The hydraulic pump 20 discharges hydraulic fluid for causing the slewing motor 30 and the optional cylinder 10 to operate. Specifically, the slewing motor 30 which slews the upper slewing body 2 and the optional cylinder 10 which cause each of the optional devices 6A to 6D to operate are connected to the common hydraulic pump 20. The hydraulic pump 20 is driven by an engine (not shown) to discharge hydraulic fluid in a tank 21.

The hydraulic pump 20 is a variable displacement hydraulic pump with a pump discharge amount (pump displacement) adjustable. In the hydraulic pump 20, a regulator 22 is provided which receives input of a displacement instruction signal from a controller 70 to be described later to adjust a displacement of the hydraulic pump 20 to be a displacement corresponding to the displacement instruction signal.

The slewing control valve 40 is a control valve interposed between the hydraulic pump 20 and the slewing motor 30 to guide hydraulic fluid for driving the slewing motor 30 from the hydraulic pump 20 to either the first port 30*a* or the second port 30*b* of the slewing motor 30, thereby controlling a direction of hydraulic fluid to be supplied to the slewing motor 30, as well as controlling a flow rate of the hydraulic fluid to be supplied to the slewing motor 30.

The optional control valve 50 is a control valve interposed between the hydraulic pump 20 and the optional cylinder 10 to guide hydraulic fluid for driving the optional cylinder 10 from the hydraulic pump 20 to either a head side chamber 11H or a rod side chamber 11R of the optional cylinder 10, thereby controlling a direction of hydraulic fluid to be supplied to the optional cylinder 10, as well as controlling a flow rate of the hydraulic fluid to be supplied to the optional cylinder 10.

Each of the slewing control valve 40 and the optional control valve 50, which is formed with a pilot controlled hydraulic switching valve, receives, at a pilot port of each control valve, supply of a pilot pressure from a pilot pump (not shown) and opens in a stroke corresponding to an amount of the pilot pressure, thereby allowing supply of hydraulic fluid to the slewing motor 30 or the optional cylinder 10 at a flow rate corresponding to the stroke. Accordingly, the flow rate can be controlled by changing the pilot pressure. Specifically, the control is as follows.

The slewing control valve 40 has pilot ports 41*a* and 41*b*. The slewing control valve 40 is held at a neutral position (the center position in FIG. 7) when no pilot pressure is input to these pilot ports 41*a* and 41*b*. At the neutral position, the hydraulic pump 20 and the slewing motor 30 are cut off from each other to open a center bypass line 31, so that hydraulic fluid from the hydraulic pump 20 returns as it is to the tank 21 through the center bypass line 31.

Additionally, when more than a fixed pilot pressure is supplied to the pilot port 41*a*, the slewing control valve 40 shifts to a first driving position (a left side position in FIG. 7) from the neutral position in a stroke corresponding to an amount of the pilot pressure. At the first driving position, a pump line 32 leading to the hydraulic pump 20 and a motor line 33 leading to the first port 30*a* are connected, and also a motor line 34 leading to the second port 30*b* and a tank line 35 leading to the tank 21 are connected. This allows the hydraulic fluid from the hydraulic pump 20 to be supplied to the first port 30*a* of the slewing motor 30 at a flow rate corresponding to the stroke, as well as allowing the hydraulic fluid discharged from the second port 30*b* to be returned to the tank 21.

Additionally, when more than a fixed pilot pressure is supplied to the pilot port 41*b*, the slewing control valve 40 shifts to a second driving position (a right side position in FIG. 7) from the neutral position in a stroke corresponding to an amount of the pilot pressure. At the second driving position, the pump line 32 leading to the hydraulic pump 20 and the motor line 34 leading to the second port 30*b* are connected, and also the motor line 33 leading to the first port 30*a* and the tank line 35 leading to the tank 21 are connected. This allows the hydraulic fluid from the hydraulic pump 20 to be supplied to the second port 30*b* of the slewing motor 30 at a flow rate corresponding to the stroke, as well as allowing the hydraulic fluid discharged from the first port 30*a* to be returned to the tank 21.

The optional control valve 50 has a pair of pilot ports 51*a* and 51*b*. The optional control valve 50 is held at the neutral position (the center position in FIG. 7) when no pilot pressure is input to these pilot ports 51*a* and 51*b*, thereby cutting off the hydraulic pump 20 and the optional cylinder 10 from each other.

Additionally, when a pilot pressure is input to the pilot port 51*a*, the optional control valve 50 shifts from the neutral position to the first driving position (the left side position in FIG. 7). At the first driving position, a pump line 53 leading to the hydraulic pump 20 and a cylinder line 54 leading to the rod side chamber 11R are connected, and also a cylinder line 55 leading to the head side chamber 11H and a tank line 56 leading to a tank 52 are connected. This allows the hydraulic fluid from the hydraulic pump 20 to be supplied to the rod side chamber 11R of the optional cylinder 10 at a flow rate corresponding to the stroke, as well as allowing the hydraulic fluid discharged from the head side chamber 11H of the optional cylinder 10 to be returned to the tank 52.

Additionally, the optional control valve 50 shifts to the second driving position (the right side position in FIG. 7) from the neutral position when a pilot pressure is input to the pilot port 51*b*. At the second driving position, the pump line 53 leading to the hydraulic pump 20 and the cylinder line 55 leading to the head side chamber 11H are connected, and also the cylinder line 54 leading to the rod side chamber 11R and the tank line 56 leading to the tank 52 are connected. This allows the hydraulic fluid from the hydraulic pump 20 to be supplied to the head side chamber 11H of the optional cylinder 10 at a flow rate corresponding to the stroke, as well as allowing the hydraulic fluid discharged from the rod side chamber 11R of the optional cylinder 10 to be returned to the tank 52.

The hydraulic circuit shown in FIG. 7 further includes a plurality of detection sections, the controller 70, a slewing operation device 81, and an optional operation device 82.

The plurality of detection sections includes a slewing operation sensor 91 (a slewing operation detection section), an optional operation sensor 92 (an optional operation detection section), a slewing speed sensor 93 (a slewing speed detection section), a slewing hydraulic sensor 94 (a motor load detection section), and a pump working pressure sensor 95 (a motor load detection section).

The slewing operation sensor 91 is a sensor for detecting a pilot pressure corresponding to an amount of slewing instruction operation given by a slewing operation member 81A to be described later in the slewing operation device 81. The slewing operation sensor 91 converts a detected pilot pressure to an electric signal (a pilot pressure detection signal) and inputs the obtained signal to the controller 70.

The optional operation sensor 92 is a sensor for detecting a pilot pressure corresponding to a motion instruction operation given by an optional operation member 82A to be described later in the optional operation device 82. The optional operation sensor 92 converts a detected pilot pressure to an electric signal (the pilot pressure detection signal) and inputs the obtained signal to the controller 70.

The slewing speed sensor 93 is a sensor capable of detecting a magnitude of the slewing speed and a slewing direction of the upper slewing body 2. As the slewing speed sensor 93, for example, an encoder, a resolver, or a gyroscope sensor capable of detecting motion of the upper slewing body 2 can be used. The slewing speed sensor 93 converts detected magnitude of the slewing speed and the slewing direction of the upper slewing body 2 to an electric signal (a slewing speed detection signal) and inputs the obtained signal to the controller 70.

The slewing hydraulic sensor 94 is configured with a first motor pressure sensor 94A which generates a first motor pressure detection signal corresponding to a pressure of hydraulic fluid in the first port 30*a* of the slewing motor 30, and a second motor pressure sensor 94B which generates a second motor pressure detection signal corresponding to a pressure of hydraulic fluid in the second port 30*b* of the slewing motor 30. The first motor pressure sensor 94A and the second motor pressure sensor 94B input the motor pressure detection signal to the controller 70.

The pump working pressure sensor 95 generates a working pressure detection signal corresponding to a working pressure of the hydraulic pump 20 and inputs the generated signal to the controller 70.

The controller 70 is configured with a CPU (Central Processing Unit), a ROM (Read Only Memory) which stores various control programs, a RAM (Random Access Memory) used as a working region of a CPU, and the like.

The controller 70 includes an opening and closing motion control section 71, an optional device judgment section 72, and an operation judgment section 73 as functions. The controller 70 operates such that execution of the control program by the CPU functionally configures the opening and closing motion control section 71, the optional device judgment section 72, and the operation judgment section 73. The controller 70 controls operation (operation of the slewing motor 30, the optional cylinder 10, and the like) of the slewing-type working machine 100 by executing the control program based on signals input from the plurality of detection sections or the like. The controller 70 conducts positive control and the like of increasing/decreasing a pump discharge amount (pump displacement) according to an operation amount of the slewing operation member 81A, an operation amount of the optional operation member 82A which are to be described later, and the like.

The opening and closing motion control section 71 has a function of controlling opening and closing motion of the optional control valve 50.

The optional device judgment section 72 has a function of judging which kind of optional device, the first optional device or the second optional device, is attached to the front end portion of the arm 5 as the optional device. Specifically, the optional device judgment section 72 judges which of the optional devices 6A to 6D is attached to the front end portion of the arm 5.

The operation judgment section 73 has a function of making judgment about slewing operation by the slewing operation device 81 and optional operation by the optional operation device 82. Details of the opening and closing motion control section 71, the optional device judgment section 72, and the operation judgment section 73 will be described later.

The slewing operation device 81 has the slewing operation member 81A (a slewing operation lever) and a pilot valve 81B. Upon application of slewing instruction operation to the slewing operation member 81A by an operator, the slewing operation member 81A moves in a direction of the application.

The pilot valve 81B has an input port (not shown) which is connected to a pilot pump (not shown) and a pair of output ports (not shown). The pair of output ports is connected to the pilot port 41*a* and the pilot port 41*b* in the slewing control valve 40 via a pilot line 84*a* and a pilot line 84*b*, respectively. The pilot valve 81B is coupled to the slewing operation member 81A and opens to allow supply of a pilot pressure to a pilot port, either one of the pair of pilot ports 41*a* and 41*b* corresponding to a direction of slewing instruction operation applied to the slewing operation member 81A, the pilot pressure corresponding to an amount of the slewing instruction operation from the pilot pump.

The optional operation device 82 has the optional operation member 82A (an optional operation lever) and a pilot valve 82B. Upon application of motion instruction operation to the optional operation member 82A by an operator, the optional operation member 82A moves in a direction of the application.

The pilot valve 82B has an input port (not shown) which is connected to the pilot pump (not shown) and a pair of output ports (not shown). The pair of output ports is connected to the pilot port 51*a* and the pilot port 51*b* in the optional control valve 50 via a pair of pilot lines 85*a* and 85*b*, respectively. The pilot valve 82B is coupled to the optional operation member 82A and opens to allow supply of a pilot pressure to a pilot port, either one of the pair of pilot ports 51*a* and 51*b* corresponding to motion instruction operation applied to the optional operation member 82A, the pilot pressure corresponding to an amount of the motion instruction operation from the pilot pump.

Specifically, electromagnetic valves 83A and 83B are provided in the middle of the pair of pilot lines 85*a* and 85*b* of the pilot valve 82B. These electromagnetic valves 83A and 83B switch supply and discharge directions of pilot oil discharged from the pilot pump by operation of the optional operation member 82A. Additionally, by the control by the controller 70, the electromagnetic valves 83A and 83B change pilot pressures supplied to the pilot ports 51*a* and 51*b*, thereby controlling opening and closing motion of the optional control valve 50 to adjust opening degree of the optional control valve 50.

[Control of Slowing-Type Working Machine]

In the slewing-type working machine 100 according to the present embodiment, at the time of combined operation in which operation of the slewing operation member 81A and operation of the optional operation member 82A are simultaneously conducted, control for reducing the opening degree of the optional control valve 50 is not conducted unconditionally. In the slewing-type working machine 100, the opening and closing motion control section 71 controls the optional control valve 50 such that only when an opening reduction condition set in advance for judging whether or not the opening degree of the optional control valve 50 should be reduced is satisfied, the opening degree of the optional control valve 50 is reduced. The opening reduction condition includes a condition enabling operator's intention appearing in the operation amount of the slewing operation member 81A to be reflected. This enables an increase in a speed of the upper slewing body 2 against the operator's intention to be suppressed at the time of the combined operation, while giving priority to slewing motion when the speed of the upper slewing body 2 needs to be increased at the time of the combined operation.

In the present embodiment, the opening reduction condition includes a first opening reduction condition that the slewing operation detection section 91 detects an operation amount equal to or more than a reference operation amount SV set in advance and that the optional operation detection section 92 detects the operation received by the optional operation member 82A. The opening and closing motion control section 71 controls the optional control valve 50 such that the opening degree of the optional control valve 50 is reduced only when the first opening reduction condition is satisfied. This enables control taking into consideration operator's intention based on a comparison between the reference operation amount SV and an actual operation amount of the slewing operation member 81A by the operator.

The reference operation amount SV is a threshold value set in advance so that the reference operation amount is larger than a minimum operation amount of the slewing operation member 81A for causing slewing motion of the upper slewing body 2. In other words, the minimum operation amount is the operation amount of the slewing operation member 81A when slewing of the upper slewing body 2 actually starts. The minimum operation amount is a value larger than a detection lower limit operation amount (a detection lower limit of the slewing operation detection section 91) that allows the slewing operation detection section 91 to detect the slewing operation received by the slewing operation member 81A. The reference operation amount SV is a value arbitrarily set to construe that an operator intends to increase a speed of the upper slewing body 2. In other words, the reference operation amount SV is a value that enables an operator to be construed to intend a speed increase of the upper slewing body 2. Accordingly, the value of the reference operation amount SV is not particularly limited. Specifically mentioned, for example, the reference operation amount SV can be set to a value larger than ½ of a full stroke (a maximum stroke width) of the slewing operation member 81A. Additionally, the reference operation amount SV can be set to a value larger than ⅔ of the full stroke (the maximum stroke width).

In the present embodiment, in a case where the first opening reduction condition is not satisfied, even when, for example, in the combined operation, the operation amount of the slewing operation member 81A is less than the reference operation amount SV, control for reducing the opening degree of the optional control valve 50 is not conducted. Thus, in the present embodiment, in a case where the first opening reduction condition is not satisfied, even in the combined operation, control is conducted to maintain the opening degree of the optional control valve 50. This enables an increase in a speed of the upper slewing body 2 against the operator's intention to be suppressed at the time of the combined operation.

On the other hand, in a case where, the first opening reduction condition is satisfied, i.e. in a case where the combined operation is conducted and the operation amount of the slewing operation member 81A is equal to or more than the reference operation amount SV, it is considered that the operator intends to increase a speed of the upper slewing body 2, and control for reducing the opening degree of the optional control valve 50 is conducted. This enables slewing of the upper slewing body 2 to be reliably conducted while giving priority to slewing motion when the speed of the upper slewing body 2 needs to be increased at the time of the combined operation.

In particular, in the slewing-type working machine 100 according to the present embodiment, when the first opening reduction condition is satisfied and slewing of the upper slewing body 2 is started (when the upper slewing body 2 starts moving in the slewing direction), the control is conducted to reduce the opening degree of the optional control valve 50 and give priority to the slewing motion, so that the slewing of the upper slewing body 2 can be reliably started.

Additionally, in the present embodiment, in consideration further of working pressures of the exchangeable optional devices 6A to 6D in addition to the opening reduction condition, it is judged whether or not the control to reduce the opening degree of the optional control valve 50 is required. This enables slewing of the upper slewing body 2 to be reliably conducted by giving priority to slewing motion when the speed of the upper slewing body 2 needs to be increased while preventing execution of useless control. Specific operation is as follows.

In the hydraulic circuit shown in FIG. 7, in which hydraulic fluid is supplied to the optional cylinder 10 and the slewing motor 30 from one hydraulic pump 20 to drive the optional cylinder 10 and the slewing motor 30, in a case where a working pressure of the optional cylinder 10 is low, a working pressure of the slewing motor 30 accordingly becomes low, so that slewing motion, in particular, slewing start, cannot be smoothly conducted. In such a case, on condition that the opening reduction condition is satisfied, slewing motion, in particular, slewing start, can be smoothly conducted by conducting the control to reduce the opening degree of the optional control valve 50.

By contrast, in a case where the working pressure of the optional cylinder 10 is relatively high, the working pressure of the slewing motor 30 accordingly becomes high, so that a pressure at the time of slewing motion, in particular, at the time of slewing start, can be ensured. In such a case, even when the first opening reduction condition is satisfied, the control for reducing the opening degree of the optional control valve 50 is not required. Conducting the control to reduce the opening degree of the optional control valve 50 in such a case rather invites a concern that a shortage of a flow rate of hydraulic fluid to be supplied to the optional cylinder 10 might cause each of the optional devices 6A to 6D to have difficulty in moving.

Under these circumstances, in the present embodiment, in a case where the opening reduction condition is satisfied and the first optional device (the grapple 6A or the fork 6D) having a relatively low working pressure among the optional devices 6A to 6D is used as an optional device, the opening and closing motion control section 71 conducts the control to reduce the opening degree of the optional control valve 50, while even in a case where the opening reduction condition is satisfied, when the second optional device (the crusher 6B or the breaker 6C) having a relatively high working pressure among the optional devices 6A to 6D is used as an optional device, control to reduce the opening degree of the optional control valve 50 is not conducted. This enables slewing of the upper slewing body 2 to be reliably conducted by giving priority to slewing motion when the speed of the upper slewing body 2 needs to be increased while preventing execution of useless control.

Control Example 1

Figure 8:
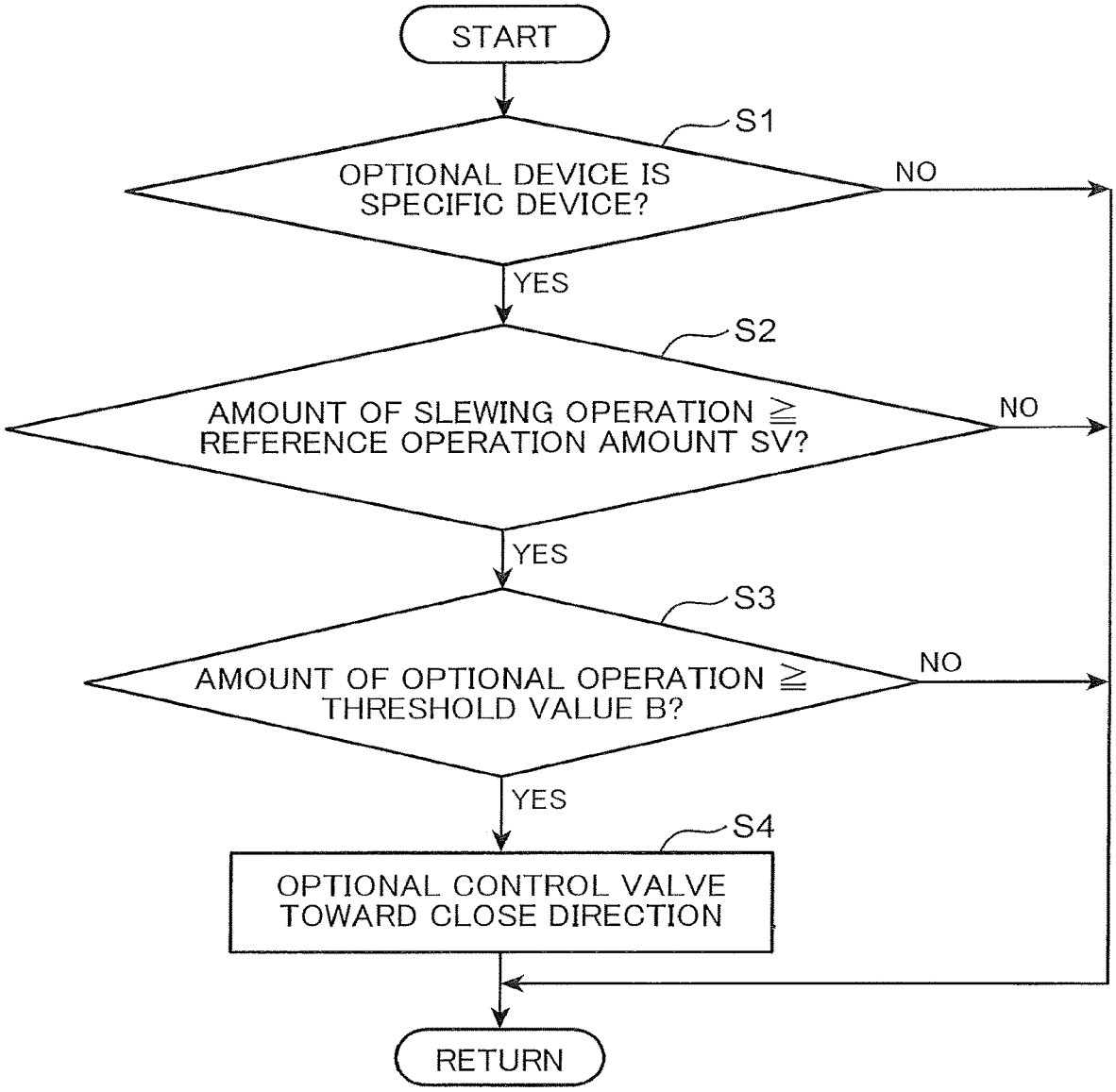
FIG. 8 is a flow chart showing Control Example 1 for controlling the slewing-type working machine according to the present embodiment.

FIG. 8 is a flow chart showing Control Example 1 for controlling the slewing-type working machine 100 according to the present embodiment.

In Control Example 1 shown in FIG. 8, the optional device judgment section 72 judges whether or not the optional device attached to the front end portion of the arm 5 is a specific device set in advance, i.e. whether or not it is the first optional device (Step S1). Specifically, the optional device judgment section 72 judges which of the optional devices 6A to 6D the optional device is.

The judgment can be made, for example, in the following manner. Specifically, an operator inputs, to an operation panel (not shown), a kind of the optional device attached to the front end portion of the arm 5, specifically, information corresponding to any of the optional devices 6A to 6D, and a signal corresponding to the input information related to the optional device is input to the controller 70. Then, the optional device judgment section 72 can judge which of the optional devices 6A to 6D the optional device is, based on the signal input to the controller 70. Additionally, it may be configured such that when any of the optional devices 6A to 6D is attached to the front end portion of the arm 5, a signal corresponding to the optional device is automatically input to the controller 70, so that the optional device judgment section 72 can judge which of the optional devices 6A to 6D the optional device is, based on the signal.

In a case where the optional device attached to the front end portion of the arm 5 is the first optional device having a low working pressure, specifically, the grapple 6A or the fork 6D shown in FIG. 6 (YES in Step S1), the operation judgment section 73 judges whether or not an amount of slewing operation by the slewing operation member 81A is equal to or more than the reference operation amount SV (Step S2).

In a case where the amount of slewing operation is equal to or more than the reference operation amount SV (YES in Step S2), the operation judgment section 73 judges whether or not an amount of optional operation by the optional operation member 82A is equal to or more than a threshold value B set in advance (Step S3). The threshold value B is set to be a value that allows judgment as to whether or not operation of the optional operation member 82A for causing the optional devices 6A to 6D to operate is conducted by an operator. Specifically, the threshold value B can be set to a value, for example, corresponding to a minimum operation amount of the optional operation member 82A for causing the optional devices 6A to 6D to operate. The threshold value B may be a value larger than the minimum operation amount.

In a case where the amount of optional operation is equal to or more than the threshold value B (YES in Step S3), the opening and closing motion control section 71 controls the optional control valve 50 to reduce the opening degree of the optional control valve 50 (Step S4) and the controller 70 repeats the above-described series of control (Steps S1 to S4).

On the other hand, in a case where the optional device attached to the front end portion of the arm 5 is the second optional device having a high working pressure, specifically, the crusher 6B or the breaker 6C shown in FIG. 6 (NO in Step S1), the opening and closing motion control section 71 does not conduct the control to reduce the opening degree of the optional control valve 50.

Additionally, even when the optional device is the first optional device having a low working pressure (YES in Step S1), if the amount of slewing operation is less than the reference operation amount SV (NO in Step S2), the opening and closing motion control section 71 does not conduct the control to reduce the opening degree of the optional control valve 50 and the controller 70 repeats the above-described series of control (Step S1 to S4).

Additionally, in a case where the optional device is the first optional device having a low working pressure (YES in Step S1), and even when the amount of slewing operation is equal to or more than the reference operation amount SV (YES in Step S2), if the amount of optional operation is less than the threshold value B (NO in Step S3), the opening and closing motion control section 71 does not conduct the control to reduce the opening degree of the optional control valve 50 and the controller 70 repeats the above-described series of control (Steps S1 to S4).

In Control Example 1 shown in the flow chart of FIG. 8, the following control can be also further added related to adjustment of the opening degree of the optional control valve. A graph (A) of FIG. 9 is a graph showing a relation between the operation amount of the slewing operation member 81A and the opening degree of the optional control valve 50 in the slewing-type working machine 100 according to the present embodiment.

Figure 9:
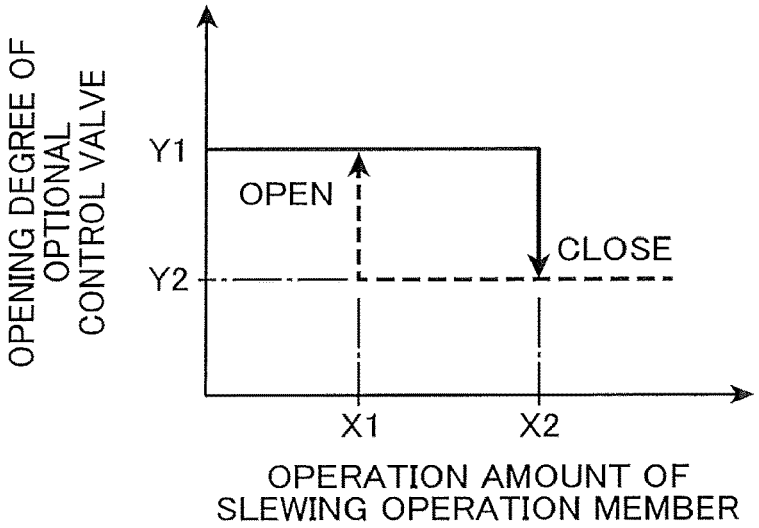
FIG. 9 are graphs each showing a relation between an operation amount of a slewing operation member and opening degree of the optional control valve in the slewing-type working machine according to the present embodiment.
Figure 9:
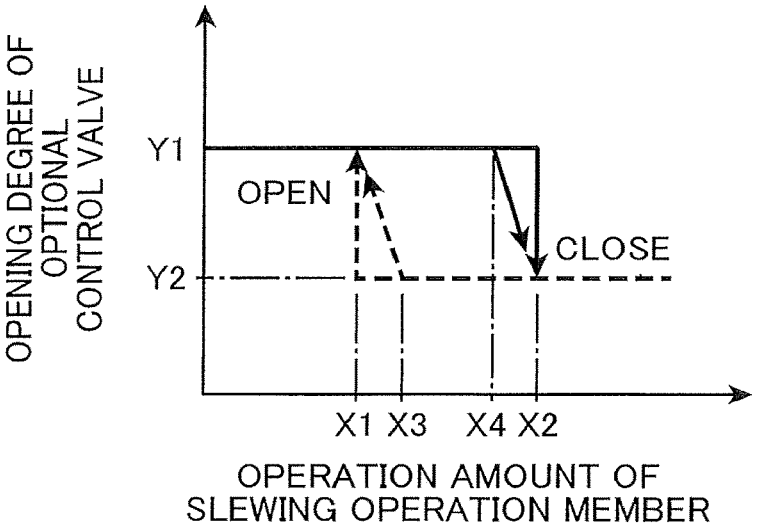
Figure 9:
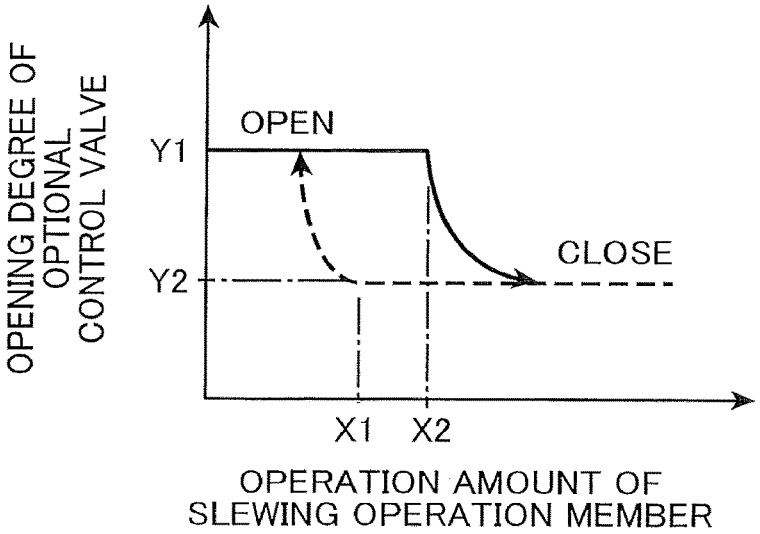

On a vertical axis in the graph (A) of FIG. 9, an opening Y1 represents opening degree of the optional control valve 50 before the first opening reduction condition is satisfied and an opening Y2 represents opening degree of the optional control valve 50 when the control to reduce the opening degree of the optional control valve 50 is conducted by the opening and closing motion control section 71 after the first opening reduction condition is satisfied. On a horizontal axis in the graph (A) of FIG. 9, an operation amount X2 corresponds to the reference operation amount SV. An operation amount X1 is an operation amount as a reference to judge whether or not the opening degree of the optional control valve 50 is to be returned from the opening Y2 to the opening Y1 when the operation amount of the slewing operation member 81A becomes less than the reference operation amount SV after the first opening reduction condition is satisfied and the opening and closing motion control section 71 conducts the control to reduce the opening degree of the optional control valve 50. Accordingly, in the flow chart of FIG. 8, the opening and closing motion control section 71 conducts the control to reduce the opening degree of the optional control valve 50 (Step S4), and thereafter, in a case where the operation amount of the slewing operation member 81A becomes equal to or less than the operation amount X1, the opening and closing motion control section 71 controls the optional control valve 50 so as to return the opening degree of the optional control valve 50 from the opening Y2 to the opening Y1.

Additionally, in the slewing-type working machine 100 according to the present embodiment, a relation between the operation amount of the slewing operation member 81A and the opening degree of the optional control valve 50 may be as shown in the graphs (B) and (C) of FIG. 9. For example, as shown in the graph (B) of FIG. 9, a plurality of operation amounts may be set as a reference for judging whether or not the opening degree of the optional control valve 50 should be reduced from Y1 to Y2, such as operation amounts X2 and X4. Similarly, as a reference for judging whether or not the opening degree of the optional control valve 50 should be returned from Y2 to Y1, a plurality of operation amounts may be set such as operation amounts X1 and X3. Additionally, adjustment of the opening degree of the optional control valve 50 may be conducted so as not to switch between two of the opening Y1 and the opening Y2 set in advance but to switch among three or more openings set in advance.

Additionally, for example, as shown in the graph (C) of FIG. 9, the opening degree of the optional control valve 50 may be smoothly increased or decreased after the operation amount of the slewing operation member 81A reaches the threshold value X1 or the threshold value X2. In this case, an increase or decrease of the opening degree of the optional control valve 50 may be conducted according to a function set in advance.

Control Example 2

Next, Control Example 2 for controlling the slewing-type working machine 100 according to the present embodiment will be described.

In Control Example 2, the opening reduction condition includes a second opening reduction condition as shown below, and even in a case where the first opening reduction condition shown in Control Example 1 is not satisfied, the opening and closing motion control section 71 conducts the control to reduce the opening degree of the optional control valve 50 when the second opening reduction condition is satisfied. Specifically, the second opening reduction condition is a condition that a time point when the optional operation detection section 92 detects the operation received by the optional operation member 82A is earlier than a time point when the slewing operation detection section 91 detects the slewing operation received by the slewing operation member 81A and that a slewing speed detected by the slewing speed sensor 93 is equal to or less than a threshold value D set in advance.

In this Control Example 2, also in a case where the second opening reduction condition is satisfied at the time of the combined operation, it is possible to reliably start slewing of the upper slewing body 2 by giving priority to slewing motion when the speed of the upper slewing body 2 needs to be increased, in particular, when the slewing speed is low as in starting the slewing of the upper slewing body 2, while suppressing a speed increase of the upper slewing body 2 not intended by an operator. The reason for defining such second opening reduction condition is as follows.

Figure 10:
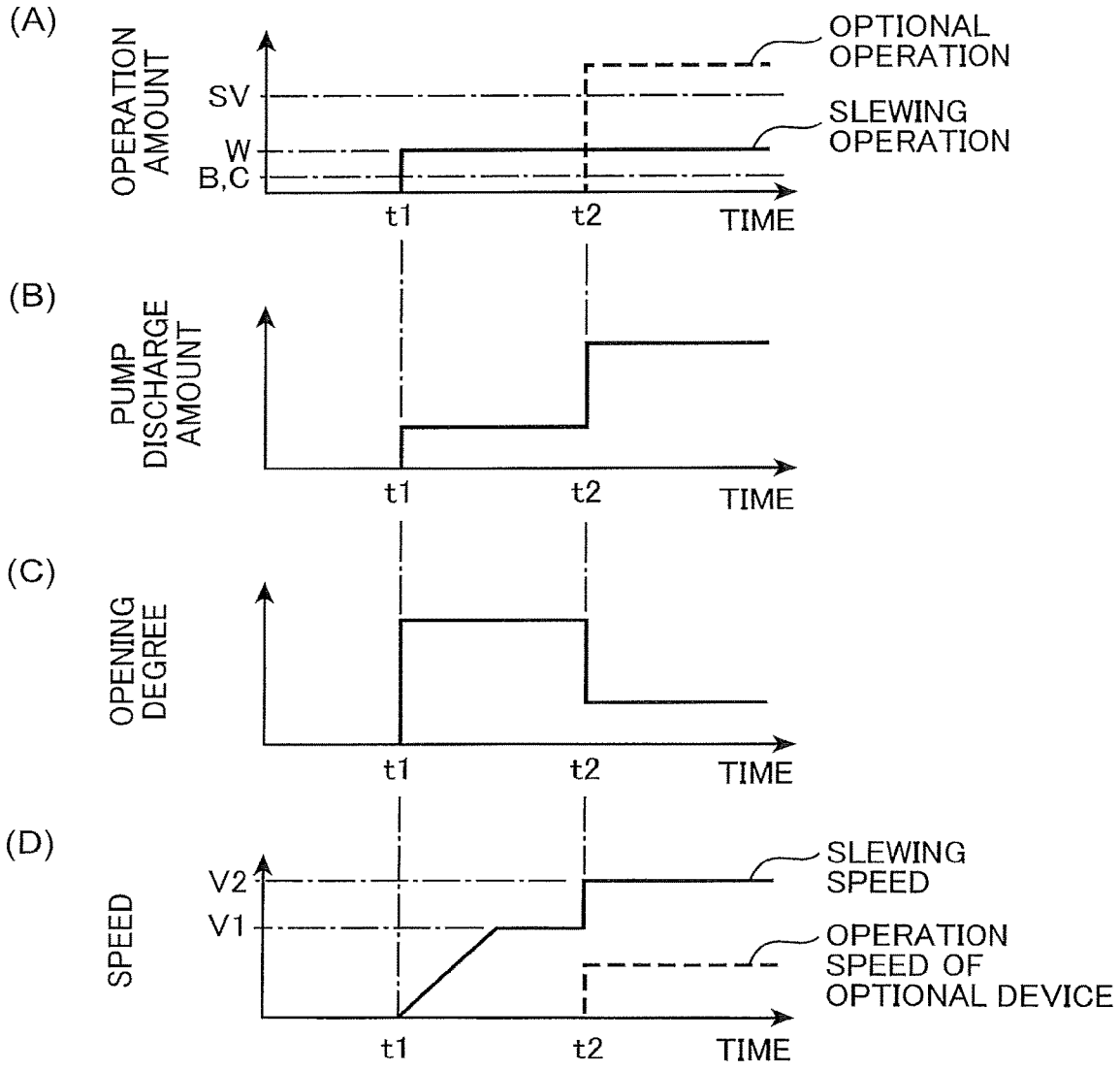
FIG. 10 show graphs for describing a second opening reduction condition in Control Example 2 for controlling the slewing-type working machine according to the present embodiment.
Figure 11:
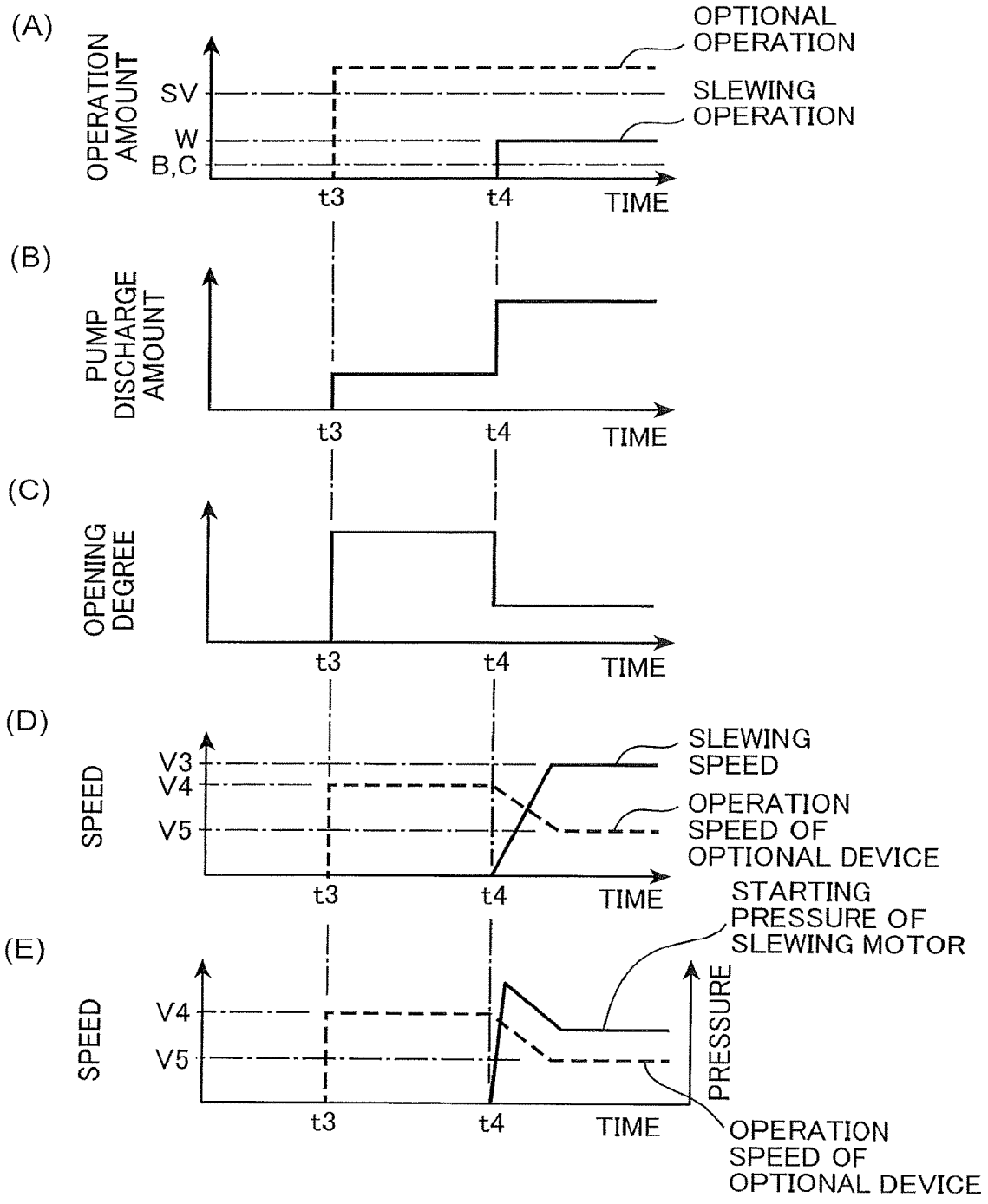
FIG. 11 show graphs for describing the second opening reduction condition in Control Example 2.

FIG. 10 and FIG. 11 show graphs for describing the second opening reduction condition. FIG. 10 shows properties in a case where at the time of the combined operation, slewing operation for slewing the upper slewing body 2 is earlier than optional operation for operating each of the optional devices 6A to 6D, and FIG. 11 shows properties in a case where the optional operation is earlier than the slewing operation.

In each of FIG. 10 and FIG. 11, a graph (A) shows a relation between operation amounts of the operation members 81A and 82A and time, a graph (B) shows a relation between a pump discharge amount and time, a graph (C) shows a relation between the opening degree of the optional control valve 50 and time, and a graph (D) shows a relation between the slewing speed of the upper slewing body 2 and an operation speed of the optional device and time.

The graph (A) of FIG. 10 shows a case where slewing operation is started at a time point of time t1, optional operation is started at a time point of time t2 later than the time t1 (when the slewing operation is earlier than the optional operation), and an operation amount W of the slewing operation member 81A and an operation amount of the optional operation member 82A are fixed. The operation amount W of the slewing operation member 81A is a value smaller than the above-described reference operation amount SV.

In such a case, as shown in the graph (C) of FIG. 10, when the control to reduce the opening degree of the optional control valve 50 is conducted at the time point of time t2 where the optional operation is started (i.e. the time point when the combined operation is started), even if the operation amount W of the slewing operation member 81A is fixed, the slewing speed is increased from a speed V1 to a speed V2 against the operator's intention as shown in the graph (D) of FIG. 10. This is because the hydraulic pump 20 has a variable displacement and when the positive control is conducted, a discharge amount of the pump 20 is increased at the time point of time t2 where the optional operation is started as shown in the graph (B) of FIG. 10.

The graph (A) of FIG. 11 shows a case where the optional operation is started at a time point of time t3, the slewing operation is started at a time point of time t4 later than the time t3 (when the optional operation is earlier than the slewing operation), and the operation amount of the slewing operation member 81A and the operation amount of the optional operation member 82A are fixed. In such a case, as shown in the graph (C) of FIG. 11, even when the control to reduce the opening degree of the optional control valve 50 is conducted at the time point of time t4 where the slewing operation is started (i.e. the time point when the combined operation is started), the slewing speed will not be increased against the operator's intention as shown in the graph (D) of FIG. 10. As shown in the graph (B) of FIG. 11, while the discharge amount of the pump 20 is increased at the time point of time t4 where the slewing operation is started, the slewing speed is smoothly and gradually increased up to a speed V3 from the time point of time t4 where the slewing operation is started. Therefore, the operator will not feel an abrupt increase in the slewing speed as shown in the graph (D) of FIG. 10.

Accordingly, as shown in FIG. 11, in a case where the optional operation is earlier than the slewing operation, by conducting the control to reduce the opening degree of the optional control valve 50 at the start of the combined operation, it is possible to reliably start slewing of the upper slewing body 2 by giving priority to slewing motion, while suppressing an increase in the slewing speed of the upper slewing body 2 not intended by an operator.

Figure 12:
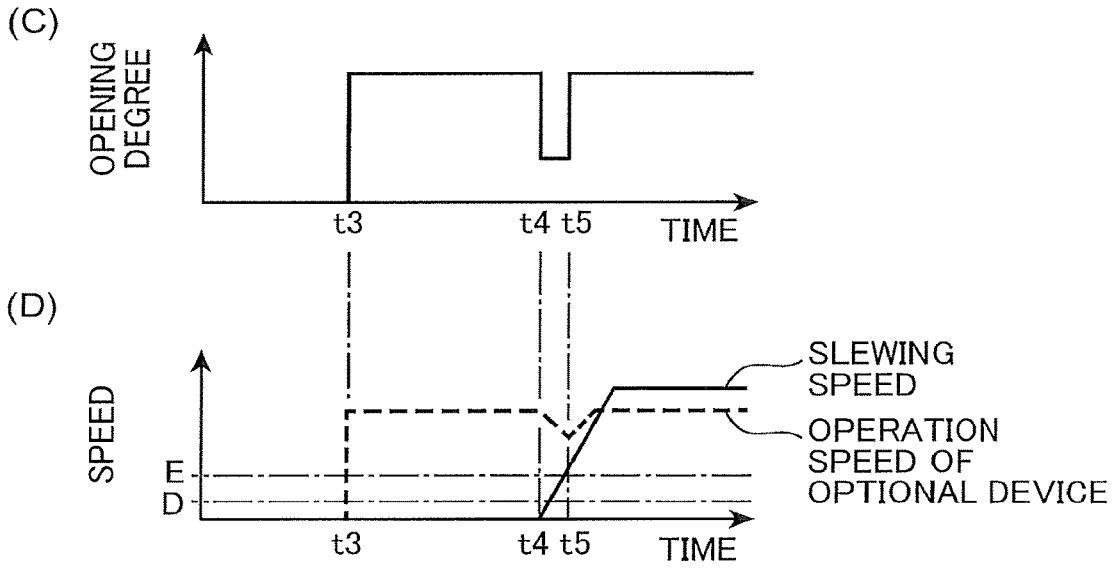
FIG. 12 show graphs for describing a more preferred mode of the second opening reduction condition in Control Example 2.

FIG. 12 is a graph for describing a more preferred mode of the second opening reduction condition in Control Example 2. In this mode, in place of such control of the opening degree of the optional control valve 50 as shown in the graph (C) of FIG. 11, reduction in the operation speed of each of the optional devices 6A to 6D caused by a reduction in the opening degree of the optional control valve 50 can be suppressed by conducting control of the opening degree of the optional control valve 50 as shown in the graph (C) of FIG. 12. Specifically, the control is as follows.

In the above-described control shown in the graph (C) of FIG. 11, since the control to reduce the opening degree of the optional control valve 50 is conducted at the time point of time t4 where the combined operation is started, the operation speed of the optional device is reduced from a speed V4 before the start of the combined operation to a speed V5 after the start of the combined operation as shown in the graph (D) of FIG. 11.

Here, giving priority to the slewing motion is required most at the start of the slewing motion of the upper slewing body 2. When the control to reduce the opening degree of the optional control valve 50 is conducted at the time point of time t4 where the combined operation is started, the slewing speed of the upper slewing body 2 is quickly increased. On the other hand, after the slewing speed is increased to some extent, giving priority to the slewing motion is less required as compared to at the start of the slewing motion.

In consideration of these respects, the following control is conducted in the more preferred mode shown in FIG. 12. Specifically, as shown in the graph (C) of FIG. 12, slewing of the upper slewing body 2 is reliably started by reducing the opening degree of the optional control valve 50 at the time point of time t4 where the combined operation is started, thereby giving priority to the slewing motion conducted at the start of the slewing motion. Then, the opening degree of the optional control valve 50 is increased at a time point of time t5 where the slewing speed of the upper slewing body 2 becomes equal to or more than a threshold value E (speed E) set in advance. This enables a reduction in the operation speed of the optional device to be suppressed. In the graph (C) of FIG. 12, while the opening degree of the optional control valve 50 is returned at the time point of time t5 to a value as of before the start of the combined operation, the opening may be increased to a value different from that as of before the start.

Figure 13:
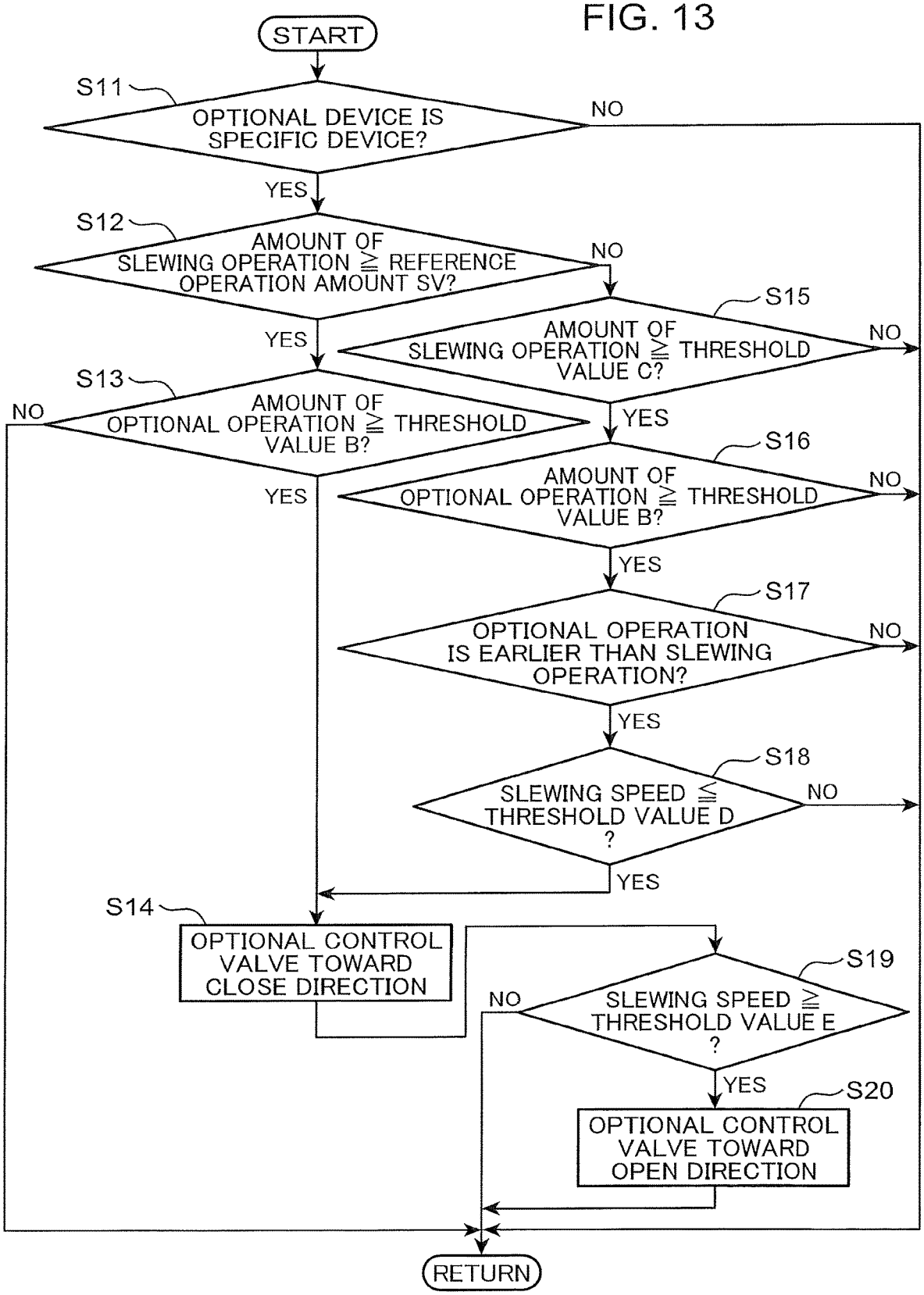
FIG. 13 is a flow chart showing Control Example 2.

FIG. 13 is a flow chart showing Control Example 2 in the slewing-type working machine 100 according to the present embodiment. Since Steps S11 to S14 in Control Example 2 shown in FIG. 13 are the same processing as that of Steps S1 to S4 in Control Example 1 shown in FIG. 8, no detailed description thereof will be made.

In Control Example 2, in a case where the amount of slewing operation by the slewing operation member 81A is less than the reference operation amount SV (NO in Step S12) as shown in FIG. 13, i.e., the first opening reduction condition is not satisfied, the following processing will be conducted. In Steps S15 to S18 shown in FIG. 13, judgment is made as to whether or not the second opening reduction condition is satisfied. In a case where the second opening reduction condition is satisfied, the control to reduce the opening degree of the optional control valve 50 is conducted in Step S14. Specifically, the processing is as follows.

The operation judgment section 73 judges whether or not the amount of slewing operation by the slewing operation member 81A is equal to or more than a threshold value C set in advance (Step S15). The threshold value C is set to be a value enabling judgment as to whether or not operation of the slewing operation member 81A is conducted by an operator, the operation being for causing the slewing motion of the upper slewing body 2. Specifically, the threshold value C can be set to, for example, a value corresponding to the minimum operation amount of the slewing operation member 81A for causing the upper slewing body 2 to conduct slewing motion. In other words, the threshold value C can be set to the minimum operation amount of the slewing operation member 81A by which slewing of the upper slewing body 2 is actually started. The threshold value C is a value smaller than the reference operation amount SV. The threshold value C is a value larger than the detection lower limit operation amount that allows the slewing operation detection section 91 to detect the slewing operation received by the slewing operation member 81A.

In a case where the amount of slewing operation is equal to or more than the threshold value C (YES in Step S15), the operation judgment section 73 judges whether or not the amount of optional operation by the optional operation member 82A is equal to or more than the threshold value B set in advance (Step S16). The threshold value B is set to be a value that enables judgment as to whether or not operation of the optional operation member 82A for causing the operation of each of the optional devices 6A to 6D is conducted by an operator. Specifically, the threshold value B can be set to, for example, a value corresponding to the minimum operation amount of the optional operation member 82A for causing the operation of each of the optional devices 6A to 6D. The threshold value B may be a value larger than the minimum operation amount. The threshold value B is the same value as the threshold value B in Step S13 of FIG. 13, and as the threshold value B in Step S3 of FIG. 8 which has been described in Control Example 1.

In a case where the amount of optional operation is equal to or more than the threshold value B (YES in Step S16), it is considered that the combined operation is being conducted. In such a case, the operation judgment section 73 judges whether or not a time point when the optional operation detection section 92 detects the operation received by the optional operation member 82A is earlier than a time point when the slewing operation detection section 91 detects the slewing operation received by the slewing operation member 81A (Step S17).

In a case where the optional operation is earlier than the slewing operation (YES in Step S17), the controller 70 judges whether or not the slewing speed of the upper slewing body 2 detected by the slewing speed sensor 93 is equal to or less than the threshold value D set in advance (Step S18). The threshold value D is a value for judging whether or not the upper slewing body 2 is in a stage of the start of the slewing motion or in an initial stage after the slewing start as shown in the graph (D) of FIG. 12.

In a case where the slewing speed is equal to or less than the threshold value D (YES in Step S18), the opening and closing motion control section 71 controls the optional control valve 50 so as to reduce the opening degree of the optional control valve 50 (Step S14). Thus, in a case where the optional operation is earlier than the slewing operation and the slewing speed is equal to or less than the threshold value D, by conducting the control to reduce the opening degree of the optional control valve 50, it is possible to reliably start slewing of the upper slewing body 2 by giving priority to slewing motion, while suppressing an increase in the speed of the upper slewing body 2 not intended by an operator.

Thereafter, after the slewing speed of the upper slewing body 2 is increased to some extent, giving priority to the slewing motion is less required as compared to at the start of the slewing motion. Accordingly, the controller 70 judges whether or not the slewing speed of the upper slewing body 2 is equal to or more than the threshold value E set in advance (Step S19). The threshold value E is set to be a value larger than the above threshold value D (a speed when the upper slewing body 2 is in the stage of the start of the slewing motion or in the initial stage after the slewing start). The threshold value E is a speed after the slewing start of the upper slewing body 2 is reliably conducted.

In a case where the slewing speed is equal to or more than the threshold value E (YES in Step S19), the opening and closing motion control section 71 controls the optional control valve 50 so that the opening degree of the optional control valve 50 is increased (Step S20). This enables reduction in the operation speed of each of the optional devices 6A to 6D to be suppressed as show in the graph (D) of FIG. 12.

As shown in FIG. 13, in the processing in Step S18, in a case where the slewing speed is larger than the threshold value D (NO in Step S18), the control to reduce the opening degree of the optional control valve 50 is not conducted. Additionally, in the processing in Step S19, in a case where the slewing speed is less than the threshold value E (NO in Step S19), the control to increase the opening degree of the optional control valve 50 is not conducted.

Control Example 3

Next, Control Example 3 for controlling the slewing-type working machine 100 according to the present embodiment will be described.

In Control Example 3, the opening reduction condition includes such a third opening reduction condition as described below, in which the opening and closing motion control section 71 conducts the control to reduce the opening degree of the optional control valve 50 in a case where even when the first opening reduction condition shown in Control Example 1 is not satisfied, the third opening reduction condition is satisfied. Specifically, the third opening reduction condition is a condition that a time point when the optional operation detection section 92 detects the operation received by the optional operation member 82A is earlier than a time point when the slewing operation detection section 91 detects the slewing operation received by the slewing operation member 81A, and that a load by the slewing motor 30 detected by the motor load detection section (the slewing hydraulic sensor 94 or the pump working pressure sensor 95) is equal to or less than a threshold value F set in advance.

In Control Example 3, even in a case where the third opening reduction condition is satisfied at the time of the combined operation, it is possible to reliably start slewing of the upper slewing body 2 by giving priority to slewing motion when the speed of the upper slewing body 2 needs to be increased, in particular, when the slewing of the upper slewing body 2 is started, while suppressing a speed increase of the upper slewing body 2 not intended by an operator.

As has been already described with reference to FIG. 10 and FIG. 11, the third opening reduction condition includes a condition that the optional operation is earlier than the slewing operation in order to suppress an increase in the slewing speed against the operator's intention as shown in the graph (D) of FIG. 10. In this respect, the third opening reduction condition is the same as the second opening reduction condition.

On the other hand, the third opening reduction condition is different from the second opening reduction condition in the following respect. Specifically, in Control Example 3, as a condition for judging a stage where the necessity of giving priority to slewing motion is high, i.e. judging whether or not the upper slewing body 2 is in the stage of the start of the slewing motion or in the initial stage after the slewing start, a condition related to a load by the motor is adopted in place of the condition related to the slewing speed in Control Example 2. The load by the motor can be quantified by, for example, a discharge pressure of the hydraulic pump 20 detected by the pump working pressure sensor 95, a working pressure of the slewing motor 30 detected by the slewing hydraulic sensor 94, or the like.

In the control shown in the graph (C) of FIG. 11, since the control to reduce the opening degree of the optional control valve 50 is conducted at the time point of time t4 where the combined operation is started, an operation speed of the optional device is reduced from the speed V4 as of before the start of the combined operation to the speed V5 as of after the start of the combined operation as shown in the graph (E) of FIG. 11.

Here, a time period where the necessity of giving priority to the slewing motion is the highest is the time of starting the slewing motion of the upper slewing body 2 as described above. When the control to reduce the opening degree of the optional control valve 50 is conducted at the time point of time t4 where the combined operation is started, a starting pressure at the slewing start of the slewing motor 30 is quickly increased as shown in the graph (E) of FIG. 11. On the other hand, after the starting pressure is increased to some extent, the necessity of giving priority to the slewing motion becomes lower than that at the start of the slewing motion.

Figure 14:
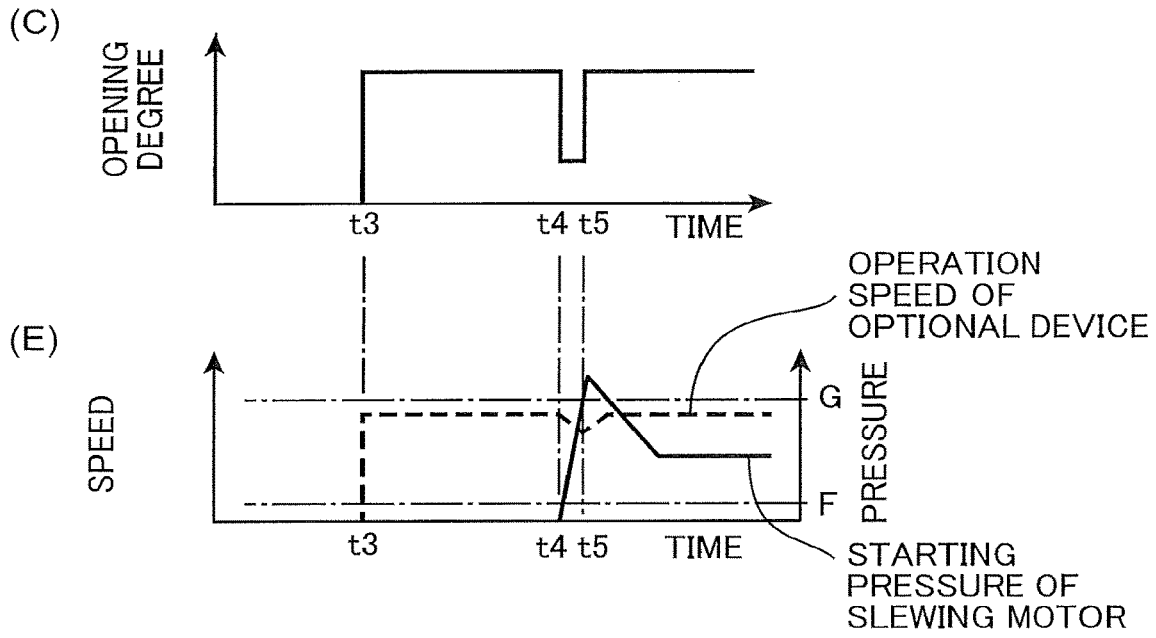
FIG. 14 show graphs for describing a third opening reduction condition in Control Example 3 for controlling the slewing-type working machine according to the present embodiment.

In view of these respects, the following control is conducted in a more preferred mode shown in FIG. 14. Specifically, as shown in the graph (C) of FIG. 14, the slewing of the upper slewing body 2 is reliably started by reducing the opening degree of the optional control valve 50 at the time point of time t4 where the combined operation is started, thereby giving priority to the slewing motion at the start of the slewing motion. Then, the opening degree of the optional control valve 50 is increased at the time point of time t5 where the starting pressure of the slewing motion becomes equal to or more than a threshold value G (pressure G) set in advance. This enables a reduction of the operation speeds of the optional devices 6A to 6D to be suppressed. While in the graph (C) of FIG. 14, at the time point of time t5, the opening degree of the optional control valve 50 is returned to a value as of before the start of the combined operation, the opening is not limited thereto and may be increased to a value different from that of before the start.

Figure 15:
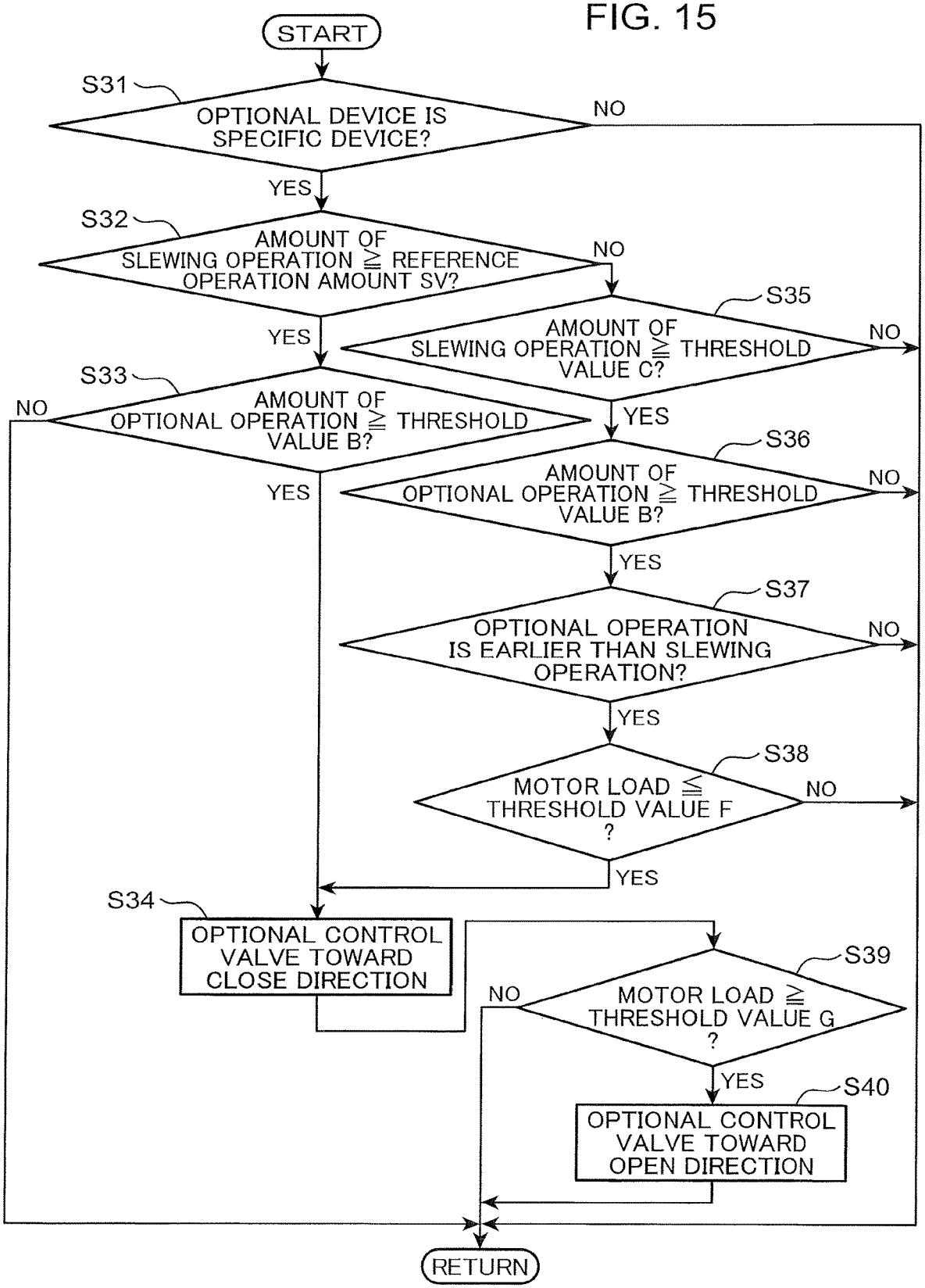
FIG. 15 is a flow chart showing Control Example 3.

FIG. 15 is a flow chart showing Control Example 3 for controlling the slewing-type working machine 100 according to the present embodiment. Since Steps S31 to S34 in Control Example 3 shown in FIG. 15 are the same processing as that of Steps S1 to S4 in Control Example 1 shown in FIG. 8, no detailed description will be made thereof.

In Control Example 3, in a case where the amount of slewing operation by the slewing operation member 81A is less than the reference operation amount SV (NO in Step S32) as shown in FIG. 15, i.e., in a case where the first opening reduction condition is not satisfied, the following processing is executed. In Steps S35 to S38 shown in FIG. 15, judgment is made as to whether or not the third opening reduction condition is satisfied. In a case where the third opening reduction condition is satisfied, the control to reduce the opening degree of the optional control valve 50 is conducted in Step S34. Specifically, the processing is as follows.

First, Steps S35 to S37 in Control Example 3 shown in FIG. 15 are the same processing as that of Steps S15 to S17 in Control Example 2 shown in FIG. 13. In a case where the optional operation is earlier than the slewing operation (YES in Step S37), the controller 70 judges whether or not the discharge pressure (the motor load) of the hydraulic pump 20 detected by, for example, the pump working pressure sensor 95 is equal to or less than the threshold value F set in advance (Step S38). The threshold value F is a value for judging whether or not the upper slewing body 2 is at the stage of the start of the slewing motion or at the initial stage after the slewing start as shown in the graph (E) of FIG. 14.

In a case where the discharge pressure (the motor load) of the hydraulic pump 20 is equal to or less than the threshold value F (YES in Step S38), the opening and closing motion control section 71 controls the optional control valve 50 so that the opening degree of the optional control valve 50 is reduced (Step S34). Thus, in a case where the optional operation is earlier than the slewing operation and the discharge pressure of the hydraulic pump 20 is equal to or less than the threshold value F, by conducting the control to reduce the opening degree of the optional control valve 50, it is possible to reliably start slewing of the upper slewing body 2 by giving priority to slewing motion, while suppressing an increase in the speed of the upper slewing body 2 not intended by an operator.

Thereafter, after the discharge pressure (the motor load) of the hydraulic pump 20 is increased to some extent, giving priority to the slewing motion is less required as compared to at the start of the slewing motion. Accordingly, the controller 70 judges whether or not the discharge pressure (the motor load) of the hydraulic pump 20 is equal to or more than the threshold value G set in advance (Step S39). The threshold value G is set to be a value larger than the above threshold value F (a pressure when the upper slewing body 2 is in the stage of the start of the slewing motion or in the initial stage after the slewing start). The threshold value G is a pressure after the slewing start of the upper slewing body 2 is reliably conducted.

In a case where the discharge pressure (the motor load) of the hydraulic pump 20 is equal to or more than the threshold value G (YES in Step S39), the opening and closing motion control section 71 controls the optional control valve 50 so that the opening degree of the optional control valve 50 is increased (Step S40). This enables reduction in the operation speed of each of the optional devices 6A to 6D to be suppressed as show in the graph (E) of FIG. 14.

As shown in FIG. 15, in the processing in Step S3.8, in a case where the motor load is larger than the threshold value F (NO in Step S38), the control to reduce the opening degree of the optional control valve 50 is not conducted. Additionally, in the processing in Step S39, in a case where the motor load is less than the threshold value G (NO in Step S39), the control to increase the opening degree of the optional control valve 50 is not conducted.

Other Modifications

While in the above embodiment, the lower travelling body 1 is used as a base body, the base body is not limited to a body capable of travelling such as the lower travelling body 1 but may be a base disposed at a specific position to support the upper slewing body 2.

While in the above embodiment, a grapple, a crusher, a breaker, and a fork are exemplified as an exchangeable optional device, the optional device is not limited thereto. The optional device may be sufficient to be an optional device itself driven by the same hydraulic pump as that drives the slewing motor. Since such an optional device generally has a working pressure lower than that of a boom or the like, application of the present invention has an advantageous effect.

Although Control Examples 1 to 3 shown in FIG. 8, FIG. 13, and FIG. 15 include the processing (Step S1, S11, S31) for judging, by the optional device judgment section 72, whether or not the optional device attached to the front end portion of the arm 5 is a specific device set in advance, the processing (Steps S1, S11, S31) may be omitted.

As described in the foregoing, there is provided a slewing-type working machine capable of giving priority to slewing motion when a speed of an upper slewing body should be increased and also capable of suppressing an increase in a speed of the upper slewing body against the operator's intention in combined operation in which slewing operation and optional operation are conducted simultaneously. The slewing-type working machine includes a base body; an upper slewing body mounted on the base body so as to be slewable; an attachment including an attachment main body attached to the upper slewing body and at least one optional device detachably attached to a front end portion of the attachment main body; a variable displacement hydraulic pump which discharges hydraulic fluid; a slewing motor which receives supply of the hydraulic fluid discharged from the hydraulic pump to operate so as to slew the upper slewing body; an optional actuator which receives supply of the hydraulic fluid discharged from the hydraulic pump to operate so as to operate the optional device; a slewing operation member configured to receive slewing operation for slewing the upper slewing body; a slewing operation detection section which detects the slewing operation received by the slewing operation member; an optional operation member configured to receive operation for causing the optional device to operate; an optional operation detection section which detects the operation received by the optional operation member; an optional control valve interposed between the hydraulic pump and the optional actuator and configured to open and close so as to change a flow rate of the hydraulic fluid supplied from the hydraulic pump to the optional actuator; and an opening and closing motion control section which controls opening and closing motion of the optional control valve. The opening and closing motion control section controls the optional control valve so as to reduce opening degree of the optional control valve only when an opening reduction condition set in advance for judging whether or not the opening degree of the optional control valve is to be reduced is satisfied. The opening reduction condition includes a first opening reduction condition that the slewing operation detection section detects an operation amount equal to or more than a reference operation amount set in advance so that the reference operation amount is larger than a minimum operation amount of the slewing operation member for causing slewing motion of the upper slewing body and that the optional operation detection section detects the operation received by the optional operation member. The opening and closing motion control section controls the optional control valve so as to reduce the opening degree of the optional control valve in a case where the first opening reduction condition is satisfied.

In the slewing-type working machine, at the time of combined operation in which operation of the slewing operation member and operation of the optional operation member are simultaneously conducted, control for reducing the opening degree of the optional control valve to give priority to slewing motion is not conducted unconditionally. The opening reduction condition for judging whether or not the opening degree of the optional control valve should be reduced includes a condition enabling operator's intention appearing in the operation amount of the slewing operation member to be reflected, and only when the opening reduction condition is satisfied, the control to reduce the opening degree of the optional control valve is conducted. This enables giving priority to slewing motion when the speed of the upper slewing body needs to be increased, and also enables an increase in a speed of the upper slewing body against the operator's intention to be suppressed. Specifically, the processing is as follows.

The reference operation amount is a value arbitrarily set to construe that an operator intends to increase a speed of the upper slewing body. Accordingly, the value of the reference operation amount is not particularly limited. In the slewing-type working machine, control taking into consideration operator's intention based on comparison between the reference operation amount and an actual operation amount.

Then, in the slewing-type working machine, the opening and closing motion control section does not always reduce the opening degree of the optional control valve at the time of the combined operation, and the control to reduce the opening degree of the optional control valve is conducted in a case where the first opening reduction condition is satisfied. Accordingly, in a case where the first opening reduction condition is not satisfied, for example, even in the combined operation, when an operation amount of the slewing operation member is less than the reference operation amount, the control to reduce the opening degree of the optional control valve is not conducted. Thus using the first opening reduction condition as a judgment condition taking the reference operation amount into consideration enables an increase in a speed of the upper slewing body against the operator's intention to be suppressed at the time of the combined operation.

On the other hand, in a case where the first opening reduction condition is satisfied, i.e. in a case where the combined operation is conducted and the operation amount of the slewing operation member is equal to or more than the reference operation amount, it is considered that the operator intends to increase a speed of the upper slewing body and the control for reducing the opening degree of the optional control valve is conducted. This enables slewing of the upper slewing body to be reliably conducted while giving priority to slewing motion when the speed of the upper slewing body needs to be increased at the time of the combined operation. The present invention has much advantageous effect because the control to reduce the opening degree of the optional control valve is conducted to give priority to slewing motion when the first opening reduction condition is satisfied and slewing of the upper slewing body is started (when the upper slewing body starts moving in the slewing direction), thereby enabling slewing of the upper slewing body to be reliably started.

In the slewing-type working machine, it is preferable that the at least one optional device includes a first optional device and a second optional device having a working pressure higher than that of the first optional device, the first optional device and the second optional device being configured to be exchangeably attached to the front end portion of the attachment main body, the slewing-type working machine further includes an optional device judgment section that judges which of the first optional device and the second optional device is attached to the front end portion of the attachment main body, and the opening and closing motion control section controls the optional control valve so as to reduce the opening degree of the optional control valve only when the opening reduction condition is satisfied and the optional device judgment section judges that the first optional device is attached to the front end portion of the attachment main body.

In this configuration, since it is judged whether or not the control to reduce the opening degree of the optional control valve is required in consideration further of a working pressure of the exchangeable optional device in addition to the first opening reduction condition, it is possible to reliably conduct slewing of the upper slewing body by giving priority to slewing motion when the speed of the upper slewing body needs to be increased, while preventing execution of useless control. Specifically, the processing is as follows.

In a hydraulic circuit, in which hydraulic fluid is supplied to an optional actuator and a slewing motor from one hydraulic pump to drive the optional actuator and the slewing motor, in a case where a working pressure of the optional actuator is low, a working pressure of the slewing motor accordingly becomes low, so that slewing motion, in particular, slewing start, cannot be smoothly conducted. In such a case, on condition that the first opening reduction condition is satisfied, slewing motion, in particular, slewing start, can be smoothly conducted by conducting the control to reduce the opening degree of the optional control valve.

By contrast, in a case where the working pressure of the optional actuator is relatively high, the working pressure of the slewing motor accordingly becomes high, so that a pressure at the time of slewing motion, in particular, at the time of slewing start, can be ensured. In such a case, even when the first opening reduction condition is satisfied, the control for reducing the opening degree of the optional control valve is not required. Further, conducting the control to reduce the opening degree of the optional control valve in such a case rather invites a concern that a shortage of a flow rate of hydraulic fluid to be supplied to the optional actuator might cause the optional devices to have difficulty in moving.

Under these circumstances, in the present configuration, in a case where the first opening reduction condition is satisfied and the first optional device having a relatively low working pressure is used as an optional device, the opening and closing motion control section conducts the control to reduce the opening degree of the optional control valve, while even in a case where the first opening reduction condition is satisfied, when the second optional device having a relatively high working pressure is used as an optional device, control to reduce the opening degree of the optional control valve is not conducted. This enables slewing of the upper slewing body to be reliably conducted by giving priority to slewing motion when the speed of the upper slewing body needs to be increased while preventing execution of useless control.

The slewing-type working machine may further include a slewing speed detection section which detects a slewing speed of the upper slewing body, in which the opening reduction condition further includes a second opening reduction condition that a time point when the optional operation detection section detects the operation received by the optional operation member is earlier than a time point when the slewing operation detection section detects the slewing operation received by the slewing operation member and that the slewing speed detected by the slewing speed detection section is equal to or less than a threshold value set in advance, and the opening and closing motion control section controls the optional control valve so as to reduce the opening degree of the optional control valve in a case where the second opening reduction condition is satisfied even when the first opening reduction condition is not satisfied.

In this configuration, even in a case where the first opening reduction condition is not satisfied at the time of the combined operation, the control to reduce the opening degree of the optional control valve is conducted when the second opening reduction condition is satisfied. Also in a case where the second opening reduction condition is satisfied at the time of the combined operation, it is possible to reliably conduct slewing of the upper slewing body by giving priority to slewing motion when the speed of the upper slewing body needs to be increased, in particular, when the slewing speed is low as in starting the slewing of the upper slewing body, while suppressing a speed increase of the upper slewing body against the operator's intention.

The slewing-type working machine may further include a motor load detection section which detects a load by the slewing motor, in which the opening reduction condition further includes a third opening reduction condition that a time point when the optional operation detection section detects the operation received by the optional operation member is earlier than a time point when the slewing operation detection section detects the slewing operation received by the slewing operation member and that the load by the slewing motor detected by the motor load detection section is equal to or less than a threshold value set in advance, and the opening and closing motion control section controls the optional control valve so as to reduce the opening degree of the optional control valve in a case where the third opening reduction condition is satisfied even when the first opening reduction condition is not satisfied.

In this configuration, even in a case where the first opening reduction condition is not satisfied at the time of the combined operation, the control to reduce the opening degree of the optional control valve is conducted when the third opening reduction condition is satisfied. Also in a case where the third opening reduction condition is satisfied at the time of the combined operation, this enables slewing of the upper slewing body to be reliably conducted by giving priority to slewing motion when the speed of the upper slewing body needs to be increased, in particular, when the slewing motor load is small as in starting the slewing of the upper slewing body, while suppressing a speed increase of the upper slewing body against the operator's intention.

This application is based on Japanese Patent application No. 2018-064923 filed in Japan Patent Office on Mar. 29, 2018, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A slewing-type working machine comprising:

a base body;

an upper slewing body mounted on the base body so as to be slewable;

an attachment including an attachment main body attached to the upper slewing body and at least one optional device detachably attached to a front end portion of the attachment main body;

a variable displacement hydraulic pump which discharges hydraulic fluid;

a slewing motor which receives supply of the hydraulic fluid discharged from the hydraulic pump to operate so as to slew the upper slewing body;

an optional device actuator which receives supply of the hydraulic fluid discharged from the hydraulic pump to operate so as to operate the optional device;

a slewing operation member configured to be operated for slewing the upper slewing body;

a slewing operation detection section which detects a slewing operation that is an operation of the slewing operation member;

an optional device operation member configured to be operated to cause the optional device to operate;

an optional device operation detection section which detects an operation of the optional device operation member;

an optional device control valve interposed between the hydraulic pump and the optional device actuator and configured to open and close so as to change a flow rate of the hydraulic fluid supplied from the hydraulic pump to the optional device actuator, the optional device control valve being connected to the hydraulic pump and a tank; and an opening and closing motion control section which controls opening and closing motion of the optional device control valve, wherein the opening and closing motion control section controls the optional device control valve so as to reduce an opening degree of the optional device control valve only when an opening reduction condition set in advance for judging whether or not the opening degree of the optional device control valve is to be reduced is satisfied;

the opening reduction condition includes a first opening reduction condition that the slewing operation detection section detects an operation amount equal to or more than a reference operation amount set in advance so that the reference operation amount is larger than a minimum operation amount of the slewing operation member for causing slewing motion of the upper slewing body and that the optional device operation detection section detects the operation of the optional device operation member, and the opening and closing motion control section controls the optional device control valve so as to reduce the opening degree of the optional device control valve when the first opening reduction condition is satisfied.

2. The slewing-type working machine according to claim 1, wherein the at least one optional device includes a first optional device and a second optional device having a working pressure higher than that of the first optional device, the first optional device and the second optional device being configured to be exchangeably attached to the front end portion of the attachment main body, the slewing-type working machine further comprises an optional device judgment section that judges which of the first optional device and the second optional device is attached to the front end portion of the attachment main body, and the opening and closing motion control section controls the optional device control valve so as to reduce the opening degree of the optional device control valve only when the opening reduction condition is satisfied and the optional device judgment section judges that the first optional device is attached to the front end portion of the attachment main body.

3. The slewing-type working machine according to claim 1, further comprising a slewing speed detection section which detects a slewing speed of the upper slewing body, wherein the opening reduction condition further includes a second opening reduction condition that a time point when the optional device operation detection section detects the operation of the optional device operation member is earlier than a time point when the slewing operation detection section detects the slewing operation of the slewing operation member and that the slewing speed detected by the slewing speed detection section is equal to or less than a threshold value set in advance, and the opening and closing motion control section controls the optional device control valve so as to reduce the opening degree of the optional device control valve in a case where the second opening reduction condition is satisfied even when the first opening reduction condition is not satisfied.

4. The slewing-type working machine according to claim 1, further comprising a motor load detection section which detects a load by the slewing motor, wherein the opening reduction condition further includes a third opening reduction condition that a time point when the optional device operation detection section detects the operation of the optional device operation member is earlier than a time point when the slewing operation detection section detects the slewing operation of the slewing operation member and that the load by the slewing motor detected by the motor load detection section is equal to or less than a threshold value set in advance, and the opening and closing motion control section controls the optional device control valve so as to reduce the opening degree of the optional device control valve in a case where the third opening reduction condition is satisfied even when the first opening reduction condition is not satisfied.

* * * * *